US006142887A

United States Patent [19]

Sullivan et al.

[11] Patent Number: 6,142,887

[45] Date of Patent: Nov. 7, 2000

[54] GOLF BALL COMPRISING A METAL, CERAMIC, OR COMPOSITE MANTLE OR INNER LAYER

[75] Inventors: Michael J. Sullivan, Chicopee; R. Dennis Nesbitt, Westfield, both of Mass.

[73] Assignee: Spalding Sports Worldwide, Inc., Chicopee, Mass.

[21] Appl. No.: 09/027,482

[22] Filed: Feb. 20, 1998

Related U.S. Application Data

[63] Continuation-in-part of application No. 08/714,661, Sep. 16, 1996

[60] Provisional application No. 60/042,120, Mar. 28, 1997, and provisional application No. 60/042,430, Mar. 28, 1997.

[51] Int. Cl.[7] ..... A63B 37/04; A63B 37/06

[52] U.S. Cl. ..... 473/374; 473/370

[58] Field of Search ..... 473/373, 374, 473/376, 358, 378, 370, 365

[56] References Cited

U.S. PATENT DOCUMENTS

| | | |
|---|---|---|
| 696,887 | 4/1902 | Kempshall . |
| 696,890 | 4/1902 | Kempshall . |
| 696,891 | 4/1902 | Kempshall . |
| 696,895 | 4/1902 | Kempshall . |
| 697,816 | 4/1902 | Davis . |
| 697,925 | 4/1902 | Kempshall . |
| 699,089 | 4/1902 | Kempshall . |
| 700,656 | 5/1902 | Kempshall . |
| 700,658 | 5/1902 | Kempshall . |
| 700,660 | 5/1902 | Kempshall . |
| 701,741 | 6/1902 | Kempshall . |
| 704,748 | 7/1902 | Kempshall . |
| 704,838 | 7/1902 | Kempshall . |
| 705,249 | 7/1902 | Kempshall . |
| 705,359 | 7/1902 | Kempshall . |
| 707,263 | 8/1902 | Saunders . |
| 711,177 | 10/1902 | Richards . |
| 711,227 | 10/1902 | Richards . |
| 711,474 | 10/1902 | Chapman . |
| 712,413 | 10/1902 | Richards . |
| 713,772 | 11/1902 | Kempshall . |
| 719,499 | 2/1903 | Painter . |
| 720,852 | 2/1903 | Smith, Jr. . |
| 727,200 | 5/1903 | Richards . |
| 739,753 | 9/1903 | Kempshall . |
| 740,403 | 10/1903 | Day . |
| 985,741 | 2/1911 | Harvey . |
| 1,182,604 | 5/1916 | Wadsworth . |
| 1,182,605 | 5/1916 | Wadsworth . |
| 1,255,388 | 2/1918 | Cobb . |
| 1,270,008 | 6/1918 | Cobb . |
| 1,339,992 | 5/1920 | Wais . |
| 1,568,514 | 1/1926 | Lewis ..... 473/364 |
| 1,586,514 | 6/1926 | Arnott . |
| 1,591,117 | 7/1926 | Floyd . |
| 2,055,326 | 9/1936 | Young . |
| 2,258,331 | 10/1941 | Miller . |
| 2,258,332 | 10/1941 | Miller . |
| 2,258,333 | 10/1941 | Miller . |
| 2,364,955 | 12/1944 | Diddel . |
| 2,786,684 | 3/1957 | Muccino . |

(List continued on next page.)

*Primary Examiner*—Jeanette Chapman
*Assistant Examiner*—M. Chambers

[57] ABSTRACT

A unique golf ball and related methods of manufacturing are disclosed in which the golf ball comprises one or more mantle layers comprising one or more metals, ceramic, or composite materials. Composite materials include silicone carbide, glass, carbon, boron carbide, aramid materials, cotton, flax, jute, hemp, silk, and combinations thereof. The golf ball may also comprise an optional polymeric spherical substrate inwardly disposed relative to the one or more mantle layers. The golf balls according to the present invention exhibit improved spin, feel, and acoustic properties. Furthermore, the one or more interior mantle layers prevent, or at least significantly minimize, coefficient of restitution loss from the golf ball, while also significantly increasing the moment of inertia of the golf ball.

7 Claims, 3 Drawing Sheets

U.S. PATENT DOCUMENTS 3,031,194 4/1962 Strayer .
3,218,075 11/1965 Shakespeare .
3,534,965 10/1970 Harrison et al. .
3,572,721 3/1971 Harrison et al. .
3,572,722 3/1971 Harrison et al. .
3,671,477 6/1972 Nesbitt .
3,908,993 9/1975 Gentiluomo .
3,940,145 2/1976 Gentiluomo .
4,085,937 4/1978 Schenk .
4,123,061 10/1978 Dusbiber .
4,431,193 2/1984 Nesbitt .
4,473,229 9/1984 Kloppenburg et al. ..... 473/357
4,483,537 11/1984 Hanada et al. .
4,653,758 3/1987 Solheim .
4,674,751 6/1987 Molitor et al. .
4,679,795 7/1987 Melvin et al. .
4,805,914 2/1989 Toland .
4,836,552 6/1989 Puckett et al. .
4,839,116 6/1989 Puckett et al. .
4,844,471 7/1989 Terence et al. .
4,848,770 7/1989 Shama ..... 473/373
4,863,167 9/1989 Matsuki et al. .
4,884,814 12/1989 Sullivan .
4,886,275 12/1989 Walker .
4,911,451 3/1990 Sullivan et al. .
4,919,434 4/1990 Saito .
4,943,055 7/1990 Corley .
4,986,545 1/1991 Sullivan .
4,995,613 2/1991 Walker .
5,002,281 3/1991 Nakahara et al. .
5,018,740 5/1991 Sullivan .
5,020,803 6/1991 Gendreau et al. .
5,037,104 8/1991 Watanabe et al. .
5,048,838 9/1991 Chikaraishi et al. .
5,068,151 11/1991 Nakamura .
5,098,205 3/1992 Sullivan .
5,120,791 6/1992 Sullivan .
5,150,905 9/1992 Yuki et al. .
5,150,906 9/1992 Molitor et al. .
5,184,828 2/1993 Kim et al. .
5,187,013 2/1993 Sullivan .
5,194,191 3/1993 Nomura et al. .
5,253,871 10/1993 Viollaz .
5,273,286 12/1993 Sun .
5,421,580 6/1995 Sugimoto et al. .
5,439,227 8/1995 Egashira et al. .
5,452,898 9/1995 Yamagishi et al. .
5,480,155 1/1996 Molitor et al. .
5,511,791 4/1996 Ebisuno et al. .
5,586,950 12/1996 Endo .
5,645,497 7/1997 Sullivan et al. .
5,683,312 11/1997 Boehm et al. ..... 473/354
5,688,191 11/1997 Cavallaro et al. ..... 473/373
5,759,676 6/1998 Cavallaro et al. ..... 428/215
5,779,561 7/1998 Sullivan et al. ..... 473/373
5,813,923 9/1998 Cavallaro et al. ..... 473/378 X
5,824,746 10/1998 Harris et al. ..... 473/378 X
5,873,796 2/1999 Cavallaro et al. ..... 473/365

GOLF BALL COMPRISING A METAL, CERAMIC, OR COMPOSITE MANTLE OR INNER LAYER

CROSS REFERENCE TO RELATED APPLICATIONS

This application claims priority from U.S. Provisional Application Ser. No. 60/042,120, filed Mar. 28, 1997; Provisional Application Ser. No. 60/042,430, filed Mar. 28, 1997; and is a continuation in part of U.S. application Ser. No. 08/714,661, filed Sep. 16, 1996.

FIELD OF THE INVENTION

The present invention relates to golf balls and, more particularly, to golf balls comprising one or more mantle layers formed from a metal, ceramic, or a composite material. The golf balls may comprise an optional polymeric outer cover and/or an inner polymeric hollow sphere substrate.

BACKGROUND OF THE INVENTION

Prior artisans have attempted to incorporate metal layers or metal filler particles in golf balls to alter the physical characteristics and performance of the balls. For example, U.S. Pat. No. 3,031,194 to Strayer is directed to the use of a spherical inner metal layer that is bonded or otherwise adhered to a resilient inner constituent within the ball. The ball utilizes a liquid filled core. U.S. Pat. No. 4,863,167 to Matsuki, et al. describes golf balls containing a gravity filler which may be formed from one or more metals disposed within a solid rubber-based core. U.S. Pat. Nos. 4,886,275 and 4,995,613, both to Walker, disclose golf balls having a dense metal-containing core. U.S. Pat. No. 4,943,055 to Corley is directed to a weighted warmup ball having a metal center.

Prior artisans have also described golf balls having one or more interior layers formed from a metal, and which feature a hollow center. Davis disclosed a golf ball comprising a spherical steel shell having a hollow air-filled center in U.S. Pat. No. 697,816. Kempshall received numerous patents directed to golf balls having metal inner layers and hollow interiors, such as U.S. Pat. Nos. 704,748; 704,838; 713,772; and 739,753. In U.S. Pat. Nos. 1,182,604 and 1,182,605, Wadsworth described golf balls utilizing concentric spherical shells formed from tempered steel. U.S. Pat. No. 1,568,514 to Lewis describes several embodiments for a golf ball, one of which utilizes multiple steel shells disposed within the ball, and which provide a hollow center for the ball.

As to the incorporation of glass or vitreous materials in golf balls, U.S. Pat. No. 985,741 to Harvey discloses the use of a glass shell. Other artisans described incorporating glass microspheres within a golf ball such as in U.S. Pat. No. 4,085,937 to Schenk.

In contrast, the use of polymeric materials in intermediate layers within a golf ball, is more popular than, for instance, the use of glass or other vitreous material. Kempshall disclosed the use of an interior coating layer of plastic in U.S. Pat. Nos. 696,887 and 701,741. Kempshall further described incorporating a fabric layer in conjunction with a plastic layer in U.S. Pat. Nos. 696,891 and 700,656. Numerous subsequent approaches were patented in which a plastic inner layer was incorporated in a golf ball. A thermoplastic outer core layer was disclosed in U.S. Pat. No. 3,534,965 to Harrison. Inner synthetic polymeric layers are noted in U.S. Pat. No. 4,431,193 to Nesbitt. An inner layer of thermoplastic material surrounding a core is described in U.S. Pat. No. 4,919,434 to Saito. An intermediate layer of an amide block polyether thermoplastic is disclosed in U.S. Pat. No. 5,253,871 to Viellaz. Golf balls with thermoplastic interior shell layers are described in U.S. Pat. No. 5,480,155 to Molitor, et al. Although satisfactory in many respects, these patents are not specifically directed to the use of reinforcement fibers or particles dispersed within a polymeric inner layer.

Prior artisans have attempted to incorporate various particles and filler materials into golf ball cores and intermediate layers. U.S. Pat. No 3,218,075 to Shakespeare discloses a core of fiberglass particles dispersed within an epoxy matrix. Similarly, U.S. Pat. No. 3,671,477 to Nesbitt discloses an epoxy-based composition containing a wide array of fillers. A rubber intermediate layer containing various metal fillers is noted in U.S. Pat. 4,863,167 to Matsuki, et al. Similarly, a rubber inner layer having filler materials is noted in U.S. Pat. No. 5,048,838 to Chikaraishi, et al. More recently, a golf ball with an inner layer of reinforced carbon graphite is disclosed in U.S. Pat. No. 5,273,286 to Sun.

In view of the ever increasing demands of the current golf industry, there exists a need for yet another improved golf ball design and construction. Specifically, there is a need for a golf ball that exhibits a high initial velocity or coefficient of restitution (COR), may be driven relatively long distances in regulation play, and which may be readily and inexpensively manufactured.

These and other objects and features of the invention will be apparent from the following summary and description of the invention, the drawings, and from the claims.

SUMMARY OF THE INVENTION

The present invention achieves the foregoing objectives and provides a golf ball comprising one or more mantle layers comprising a metal, ceramic, or a composite material. Specifically, the present invention provides, in a first aspect, a golf ball comprising a core, a spherical mantle comprising a polymeric material and a reinforcing material dispersed therein, and a polymeric outer cover disposed about and adjacent to the mantle. The polymeric material may include epoxy-based materials, thermoset materials, nylon-based materials, styrene materials, thermoplastic materials, and combinations thereof. The golf ball may further comprise a second mantle layer. That second mantle may comprise ceramic or metallic materials. The second mantel, if ceramic, may comprise silica, soda lime, lead silicate, borosilicate, aluminoborosilicate, aluminosilicate, and combinations thereof. The mantle, if metal, is preferably formed from steel, titanium, chromium, nickel, or alloys thereof. The polymeric outer cover may be formed from a low acid ionomer, a high acid ionomer, an ionomer blend, a non-ionomer elastomer, a thermoset material, or a combination thereof.

In a second aspect, the present invention provides a golf ball comprising a core, a vitreous mantle, and a polymeric outer cover. The vitreous mantle may comprise one or more reinforcing materials. The golf ball may further comprise a second mantle layer, comprising a polymeric material or one or more metals. The second mantle layer may further comprise one or more reinforcing materials dispersed therein.

The present invention also provides related methods of forming golf balls having mantles formed from metal, ceramics, or composite materials.

These and other objects and features of the invention will be apparent from the following detailed description.

DETAILED DESCRIPTION OF THE PREFERRED EMBODIMENTS

The present invention relates to golf balls comprising one or more mantle layers formed from a metal, ceramic, or a composite material. The present invention also relates to methods for making such golf balls.

Figure 1:
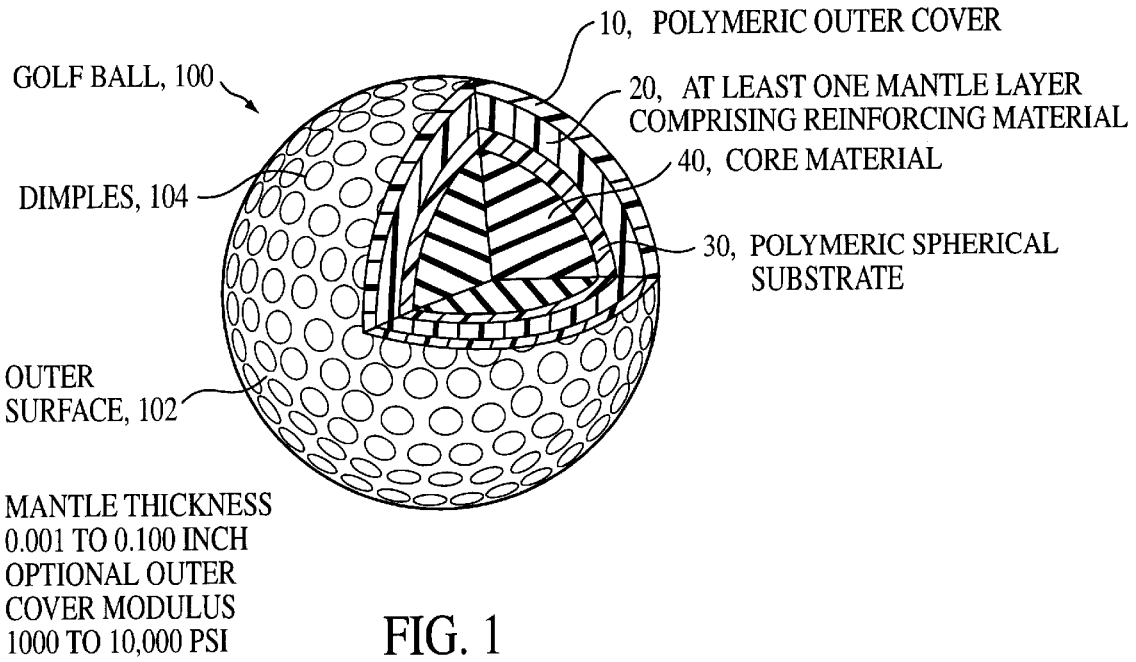
FIG. 1 is a partial cross-sectional view of a first preferred embodiment golf ball in accordance with the present invention, comprising a polymeric outer cover, at least one mantle layers, an optional polymeric hollow sphere substrate, and a core material.

FIG. 1 illustrates a first preferred embodiment golf ball 100 in accordance with the present invention. It will be understood that the referenced drawings are not necessarily to scale. The first preferred embodiment golf ball comprises an outermost polymeric outer cover 10, one or more mantle layers 20, an innermost polymeric hollow sphere substrate 30 and a core material 40. The golf ball 100 provides a plurality of dimples 104 defined along an outer surface 102 of the golf ball 100.

Figure 2:
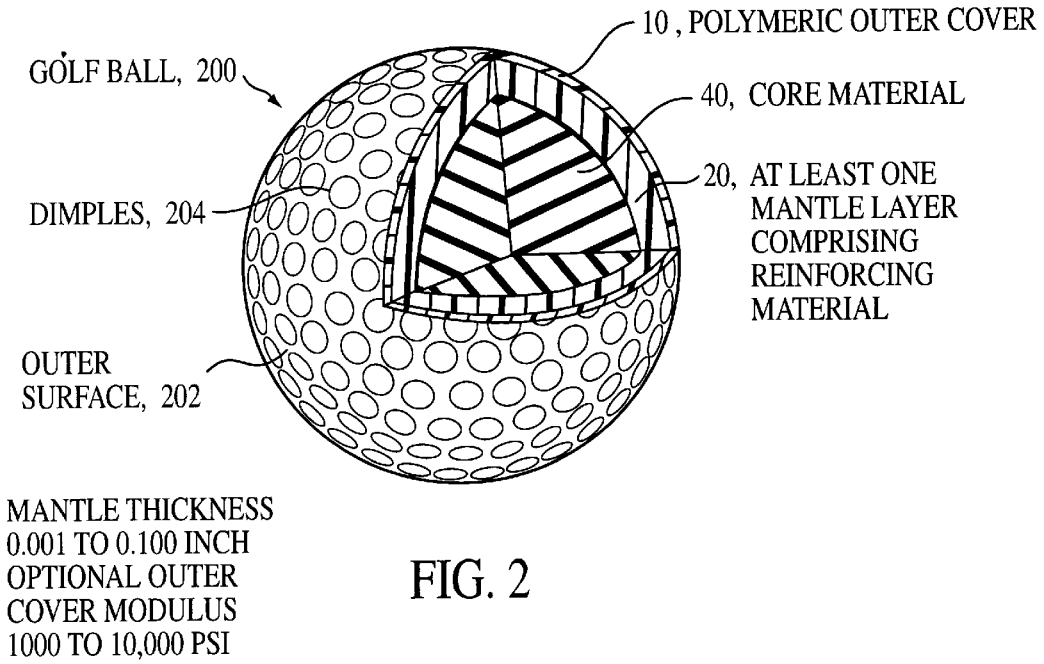
FIG. 2 is a partial cross-sectional view of a second preferred embodiment golf ball in accordance with the present invention, the golf ball comprising a polymeric outer cover, at least one mantle layers, and a core material.

FIG. 2 illustrates a second preferred embodiment golf ball 200 in accordance with the present invention. The golf ball 200 comprises an outermost polymeric outer cover 10 and one or more mantle layers 20 and a core material 40. The second preferred embodiment golf ball 200 provides a plurality of dimples 204 defined along the outer surface 202 of the ball.

Figure 3:
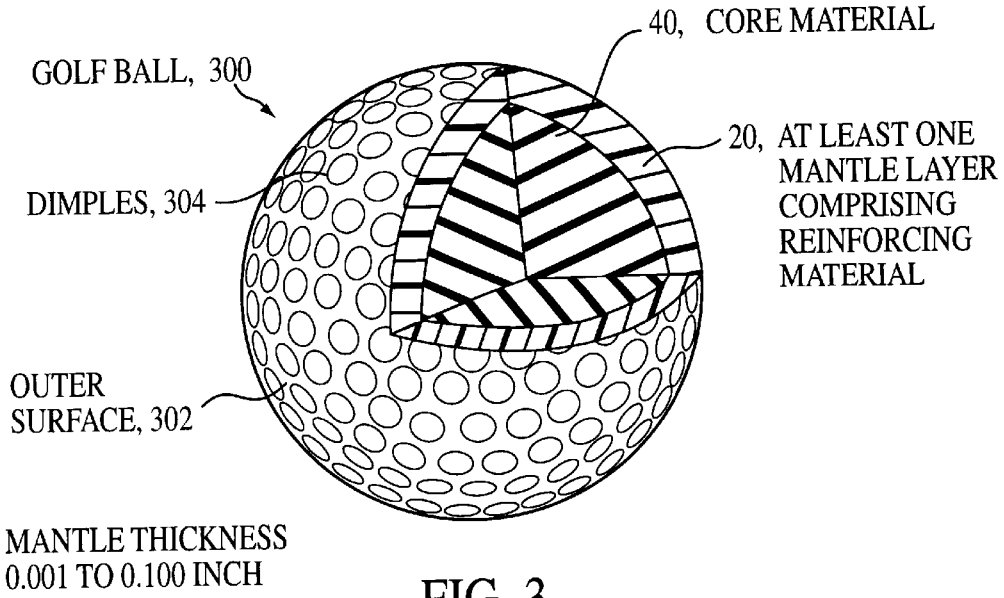
FIG. 3 is a partial cross-sectional view of a third preferred embodiment golf ball in accordance with the present invention, the golf ball comprising at least one mantle layers and a core material.

FIG. 3 illustrates a third preferred embodiment golf ball 300 in accordance with the present invention. The golf ball 300 comprises one or more mantle layers 20 and a core material 40. The golf ball 300 provides a plurality of dimples 304 defined along the outer surface 302 of the golf ball 300.

Figure 4:
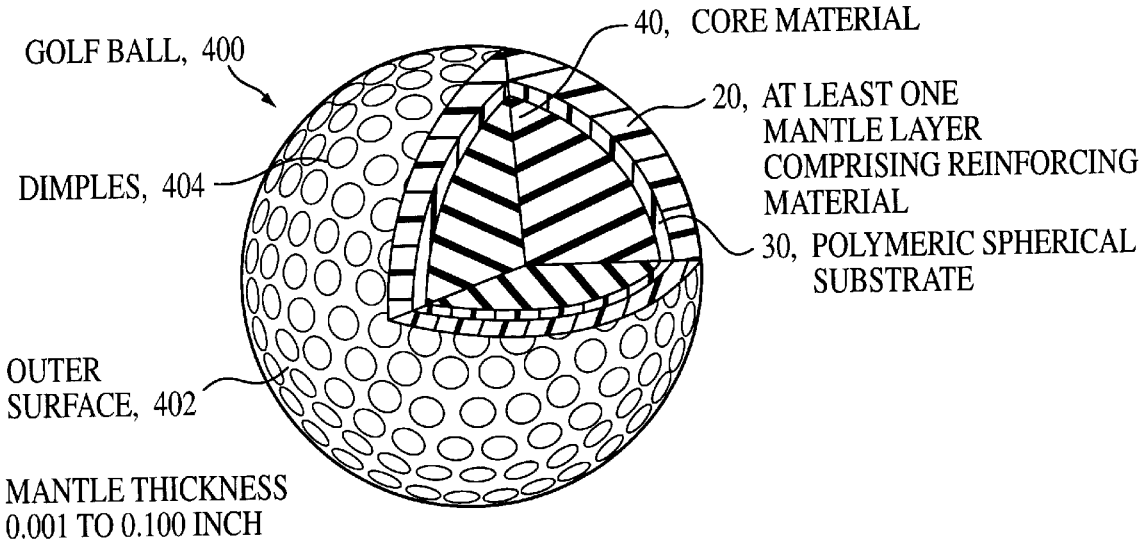
FIG. 4 is partial cross-sectional view of a fourth preferred embodiment golf ball in accordance with the present invention, the golf ball comprising at least one mantle layers, an optional polymeric hollow sphere substrate, and a core material.

FIG. 4 illustrates a fourth preferred embodiment golf ball 400 in accordance with the present invention. The golf ball 400 comprises one or more mantle layers 20, an optional polymeric hollow sphere substrate 30, and a core material 40. The golf ball 400 provides a plurality of dimples 404 defined along the outer surface 402 of the golf ball 400.

Figure 5:
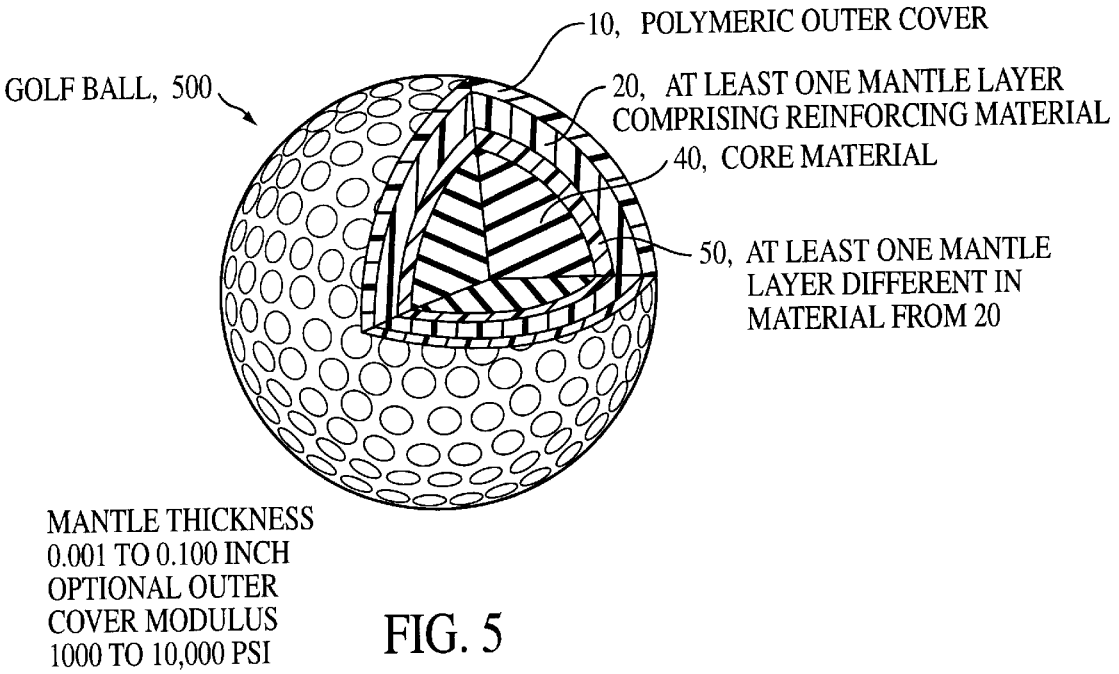
FIG. 5 is a partial cross-sectional view of a fifth preferred embodiment golf ball in accordance with the present invention, the golf ball comprising a polymeric outer cover, a first mantle layer, a second mantle layer, and a core material.

FIG. 5 illustrates a fifth preferred embodiment golf ball 500 in accordance with the present invention. The golf ball 500 comprises one or more mantle layers 20, one or more mantle layers 50 of a material different than that in the mantle layers 20, and a core material 40. The golf ball 500 has corresponding dimples as illustrated in FIGS. 1–4.

Figure 6:
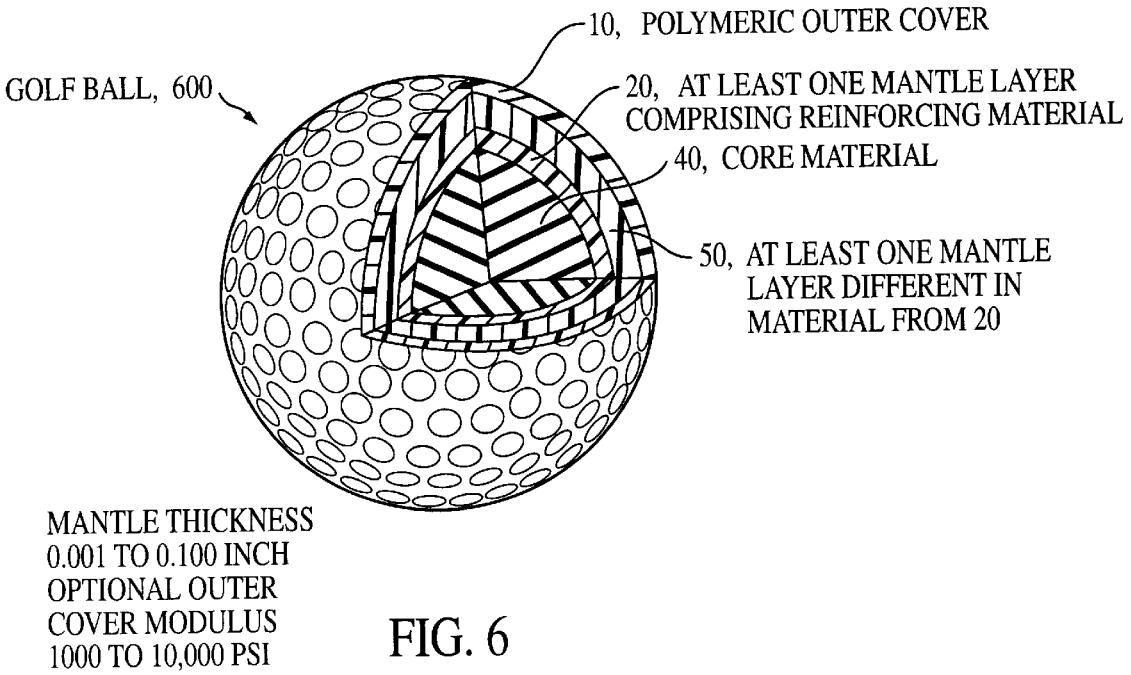
FIG. 6 is a partial cross-sectional view of a sixth preferred embodiment golf ball in accordance with the present invention, the golf ball comprising a polymeric outer cover, a first and a second mantle layer in an alternate arrangement as compared to the embodiment illustrated in FIG. 5, and a core material.

FIG. 6 illustrates a sixth preferred embodiment golf ball 600 in accordance with the present invention. The golf ball 600 is similar to the golf ball 500, however, the mantle layers 20 and 50 are reversed.

In all the foregoing noted preferred embodiments, i.e. golf balls 100, 200, 300, 400, 500, and 600, the golf balls utilize a core or core component, such as core material 40. It will be understood that all preferred embodiment golf balls may instead feature a hollow interior or hollow core. In addition, all preferred embodiment golf balls comprise one or more mantle layers, such as 20 and 50, that comprise one or more metals, ceramics, or composite materials. Details of the materials, configuration, and construction of each component in the preferred embodiment golf balls are set forth below.

Polymeric Outer Cover

The polymeric outer cover layer is comprised of a low acid (less than about 16 weight percent acid) ionomer, a high acid (greater than about 16 weight percent acid) ionomer, an ionomer blend, a non-ionomeric elastomer, a thermoset material, or blends or combinations thereof. In some applications it may be desirable to provide an outer cover that is relatively soft and that has a low modulus (about 1,000 psi to about 10,000 psi). The non-ionomeric elastomers are preferably thermoplastic elastomers such as, but not limited to, a polyurethane, a polyester elastomer such as that marketed by DuPont under the trademark Hytrel®, a polyester amide such as that marketed by Elf Atochem S.A. under the trademark Pebax®, or combinations thereof.

For outer cover compositions comprising a high acid ionomer, several new metal cation neutralized high acid ionomer resins are particularly preferred. These high acid ionomers have been produced by neutralizing, to various extents, high acid copolymers of an alpha-olefin and an alpha, beta-unsaturated carboxylic acid with a wide variety of different metal cation salts. More particularly, it has been found that numerous new metal cation neutralized high acid ionomer resins can be obtained by reacting a high acid copolymer (i.e. a copolymer containing greater than about 16 percent by weight acid, preferably from about 17 to about 25 weight percent acid, and more preferably about 20 weight percent acid), with a metal cation salt capable of ionizing or neutralizing the copolymer to the extent desired (i.e. from about 10% to 90%).

The base copolymer is made up of greater than 16 percent by weight of an alpha, beta-unsaturated carboxylic acid and alpha-olefin. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotomic acid, maleic acid, fumaric acid, and itacomic acid, with acrylic acid being preferred.

Consequently, examples of a number of copolymers suitable for use in the invention include, but are not limited to, high acid embodiments of an ethylene/acrylic acid copolymer, an ethylene/methacrylic acid copolymer, an ethylene/itaconic acid copolymer, an ethylene/maleic acid copolymer, etc. The base copolymer broadly contains greater than 16 percent by weight unsaturated carboxylic acid, and less than 84 percent by weight alpha-olefin.

Preferably, the copolymer contains about 20 percent by weight unsaturated carboxylic acid and about 80 percent by weight ethylene. Most preferably, the copolymer contains about 20 percent acrylic acid with the remainder being ethylene.

Along these lines, examples of the preferred high acid base copolymers which fulfill the criteria set forth above, are a series of ethylene-acrylic copolymers which are commercially available from The Dow Chemical Company, Midland, Mich., under the "Primacor" designation. These high acid copolymers are described in greater detail in U.S. Pat. Nos. 5,688,869 and 5,542,677, both of which are herein incorporated by reference.

Alternatively, the outer layer may include a blend of hard and soft (low acid) ionomer resins such as those described in U.S. Pat. Nos. 4,884,814 and 5,120,791, both incorporated herein by reference. Specifically, a desirable material for use in molding the outer layer comprises a blend of a high modulus (hard) ionomer with a low modulus (soft) ionomer to form a base ionomer mixture. A high modulus ionomer herein is one which measures from about 15,000 to about 70,000 psi as measured in accordance with ASTM method D-790. The hardness may be defined as at least 50 on the Shore D scale as measured in accordance with ASTM method D-2240. A low modulus ionomer suitable for use in the outer layer blend has a flexural modulus measuring from about 1,000 to about 10,000 psi, with a hardness of about 20 to about 40 on the Shore D scale.

The hard ionomer resins utilized to produce the outer cover layer composition hard/soft blends include ionic copolymers which are the sodium, zinc, magnesium or lithium salts of the reaction product of an olefin having from 2 to 8 carbon atoms and an unsaturated monocarboxylic acid having from 3 to 8 carbon atoms. The carboxylic acid groups of the copolymer may be totally or partially (i.e. approximately 15–75 percent) neutralized.

The hard ionomeric resins are likely copolymers of ethylene and either acrylic and/or methacrylic acid, with copolymers of ethylene and acrylic acid being the most preferred. Two or more types of hard ionomeric resins may be blended into the outer cover layer compositions in order to produce the desired properties of the resulting golf balls.

The hard ionomeric resins developed by Exxon Corporation and introduced under the designation Escor® and sold under the designation "Iotek" are somewhat similar to the hard ionomeric resins developed by E. I. DuPont de Nemours & Company and sold under the Surlyn® trademark. However, since the "Iotek" ionomeric resins are sodium or zinc salts of poly(ethylene-acrylic acid) and the Surlyn® resins are zinc or sodium salts of poly(ethylene-methacrylic acid) some distinct differences in properties exist. As more specifically indicated in the data set forth below, the hard "Iotek" resins (i.e., the acrylic acid based hard ionomer resins) are the more preferred hard resins for use in formulating the outer cover layer blends for use in the present invention. In addition, various blends of "Iotek" and Surlyn® hard ionomeric resins, as well as other available ionomeric resins, may be utilized in the present invention in a similar manner.

Examples of commercially available hard ionomeric resins which may be used in the present invention in formulating the outer cover blends include the hard sodium ionic copolymer sold under the trademark Surlyn®8940 and the hard zinc ionic copolymer sold under the trademark Surlyn®9910. Surlyn®8940 is a copolymer of ethylene with methacrylic acid and about 15 weight percent acid which is about 29 percent neutralized with sodium ions. This resin has an average melt flow index of about 2.8. Surlyn®9910 is a copolymer of ethylene and methacrylic acid with about 15 weight percent acid which is about 58 percent neutralized with zinc ions. The average melt flow index of Surlyn®9910 is about 0.7. The typical properties of Surlyn®9910 and 8940 are set forth below in Table 1:

TABLE 1

Typical Properties of Commercially Available Hard Surlyn ® Resins Suitable for Use in the Outer Layer Blends of the Preferred Embodiments

| | ASTM D | 8940 | 9910 | 8920 | 8528 | 9970 | 9730 |
|---|---|---|---|---|---|---|---|
| Cation Type | | Sodium | Zinc | Sodium | Sodium | Zinc | Zinc |
| Melt flow index, gms/10 min. | D-1238 | 2.8 | 0.7 | 0.9 | 1.3 | 14.0 | 1.6 |
| Specific Gravity, g/cm$^3$ | D-792 | 0.95 | 0.97 | 0.95 | 0.94 | 0.95 | 0.95 |
| Hardness, Shore D | D-2240 | 66 | 64 | 66 | 60 | 62 | 63 |
| Tensile Strength, | D-638 | (4.8) | (3.6) | (5.4) | (4.2) | (3.2) | (4.1) |
| (kpsi), MPa | | 33.1 | 24.8 | 37.2 | 29.0 | 22.0 | 28.0 |
| Elongation, % | D-638 | 470 | 290 | 350 | 450 | 460 | 460 |
| Flexural Modulus, | D-790 | (51) | (48) | (55) | (32) | (28) | (30) |
| (kpsi) MPa | | 350 | 330 | 380 | 220 | 190 | 210 |
| Tensile Impact (23° C.) | D-1822S | 1020 | 1020 | 865 | 1160 | 760 | 1240 |
| KJ/m$_2$ (ft.-lbs./in$^2$) | | (485) | (485) | (410) | (550) | (360) | (590) |
| Vicat Temperature, ° C. | D-1525 | 63 | 62 | 58 | 73 | 61 | 73 |

Examples of the more pertinent acrylic acid based hard ionomer resin suitable for use in the present outer cover composition sold under the "Iotek" trade name by the Exxon Corporation include Iotek 4000, Iotek 4010, Iotek 8000, Iotek 8020 and Iotek 8030. The typical properties of these and other Iotek hard ionomers suited for use in formulating the outer layer cover composition are set forth below in Table 2:

TABLE 2

Typical Properties of Iotek Ionomers

| | ASTM Method | Units | 4000 | 4010 | 8000 | 8020 | 8030 |
|---|---|---|---|---|---|---|---|
| Resin Properties | | | | | | | |
| Cation type | | | zinc | zinc | sodium | sodium | sodium |
| Melt index | D-1238 | g/10 min. | 2.5 | 1.5 | 0.8 | 1.6 | 2.8 |
| Density | D-1505 | $kg/m^3$ | 963 | 963 | 954 | 960 | 960 |
| Melting Point | D-3417 | ° C. | 90 | 90 | 90 | 87.5 | 87.5 |
| Crystallization Point | D-3417 | ° C. | 62 | 64 | 56 | 53 | 55 |
| Vicat Softening Point | D-1525 | ° C. | 62 | 63 | 61 | 64 | 67 |
| % Weight Acrylic Acid | | | 16 | | 11 | | |
| % of Acid Groups cation neutralized | | | 30 | | 40 | | |
| Plaque Properties (3 mm thick, compression molded) | | | | | | | |
| Tensile at break | D-638 | MPa | 24 | 26 | 36 | 31.5 | 28 |
| Yield point | D-638 | MPa | none | none | 21 | 21 | 23 |
| Elongation at break | D-638 | % | 395 | 420 | 350 | 410 | 395 |
| 1% Secant modulus | D-638 | MPa | 160 | 160 | 300 | 350 | 390 |
| Shore Hardness D | D-2240 | — | 55 | 55 | 61 | 58 | 59 |
| Film Properties (50 micron film 2.2:1 Blow-up ratio) | | | | | | | |
| Tensile at Break | | | | | | | |
| MD | D-882 | MPa | 41 | 39 | 42 | 52 | 47.4 |
| TD | D-882 | MPa | 37 | 38 | 38 | 38 | 40.5 |
| Yield point | | | | | | | |
| MD | D-882 | MPa | 15 | 17 | 17 | 23 | 21.6 |
| TD | D-882 | MPa | 14 | 15 | 15 | 21 | 20.7 |
| Elongation at Break | | | | | | | |
| MD | D-882 | % | 310 | 270 | 260 | 295 | 305 |
| TD | D-882 | % | 360 | 340 | 280 | 340 | 345 |
| 1% Secant modulus | | | | | | | |
| MD | D-882 | MPa | 210 | 215 | 390 | 380 | 380 |
| TD | D-882 | MPa | 200 | 225 | 380 | 350 | 345 |
| Dart Drop Impact | D-1709 | g/micron | 12.4 | 12.5 | 20.3 | | |

| | ASTM Method | Units | 7010 | 7020 | 7030 |
|---|---|---|---|---|---|
| Resin Properties | | | | | |
| Cation type | | | zinc | zinc | zinc |
| Melt Index | D-1238 | g/10 min. | 0.8 | 1.5 | 2.5 |
| Density | D-1505 | $kg/m^3$ | 960 | 960 | 960 |
| Melting Point | D-3417 | ° C. | 90 | 90 | 90 |
| Crystallization Point | D-3417 | ° C. | — | — | — |
| Vicat Softening Point | D-1525 | ° C. | 60 | 63 | 62.5 |
| % Weight Acrylic Acid | | | — | — | — |
| % of Acid Groups Cation Neutralized | | | — | — | — |
| Plaque Properties (3 mm thick, compression molded) | | | | | |
| Tensile at break | D-638 | MPa | 38 | 38 | 38 |
| Yield Point | D-638 | MPa | none | none | none |
| Elongation at break | D-638 | % | 500 | 420 | 395 |
| 1% Secant modulus | D-638 | MPa | — | — | — |
| Shore Hardness D | D-2240 | — | 57 | 55 | 55 |

Comparatively, soft ionomers are used in formulating the hard/soft blends of the outer cover composition. These ionomers include acrylic acid based soft ionomers. They are generally characterized as comprising sodium or zinc salts of a terpolymer of an olefin having from about 2 to 8 carbon atoms, acrylic acid, and an unsaturated monomer of the acrylate ester class having from 1 to 21 carbon atoms. The soft ionomer is preferably a zinc based ionomer made from an acrylic acid base polymer and an unsaturated monomer of the acrylate ester class. The soft (low modulus) ionomers have a hardness from about 20 to about 40 as measured on the Shore D scale and a flexural modulus from about 1,000 to about 10,000, as measured in accordance with ASTM method D-790.

Certain ethylene-acrylic acid based soft ionomer resins developed by the Exxon Corporation under the designation "Iotek 7520" (referred to experimentally by differences in neutralization and melt indexes as LDX 195, LDX 196, LDX 218 and LDX 219) may be combined with known hard ionomers such as those indicated above to produce the outer cover. The combination produces higher COR's (coefficient of restitution) at equal or softer hardness, higher melt flow (which corresponds to improved, more efficient molding, i.e., fewer rejects) as well as significant cost savings versus the outer layer of multi-layer balls produced by other known hard-soft ionomer blends as a result of the lower overall raw materials costs and improved yields.

While the exact chemical composition of the resins to be sold by Exxon under the designation Iotek 7520 is considered by Exxon to be confidential and proprietary information, Exxon's experimental product data sheet lists the following physical properties of the ethylene acrylic acid zinc ionomer developed by Exxon:

TABLE 3

Physical Properties of Iotek 7520

| Property | ASTM Method | Units | Typical Value |
|---|---|---|---|
| Melt Index | D-1238 | g/10 min. | 2 |
| Density | D-1505 | $kg/m^3$ | 0.962 |
| Cation | | | Zinc |
| Melting Point | D-3417 | ° C. | 66 |
| Crystallization Point | D-3417 | ° C. | 49 |
| Vicat Softening Point | D-1525 | ° C. | 42 |
| Plaque Properties (2 mm thick Compression Molded Plaques) | | | |
| Tensile at Break | D-638 | MPa | 10 |
| Yield Point | D-638 | MPa | None |
| Elongation at Break | D-638 | % | 760 |
| 1% Secant Modulus | D-638 | MPa | 22 |
| Shore D Hardness | D-2240 | | 32 |
| Flexural Modulus | D-790 | MPa | 26 |
| Zwick Rebound | ISO 4862 | % | 52 |
| De Mattia Flex Resistance | D-430 | Cycles | >5000 |

In addition, test data collected by the inventors indicate that Iotek 7520 resins have Shore D hardnesses of about 32 to 36 (per ASTM D-2240), melt flow indexes of 3±0.5 g/10 min (at 190° C. per ASTM D-1288), and a flexural modulus of about 2500–3500 psi (per ASTM D-790). Furthermore, testing by an independent testing laboratory by pyrolysis mass spectrometry indicates that Iotek 7520 resins are generally zinc salts of a terpolymer of ethylene, acrylic acid, and methyl acrylate.

Furthermore, the inventors have found that a newly developed grade of an acrylic acid based soft ionomer available from the Exxon Corporation under the designation Iotek 7510, is also effective, when combined with the hard ionomers indicated above in producing golf ball covers exhibiting higher COR values at equal or softer hardness than those produced by known hard-soft ionomer blends. In this regard, Iotek 7510 has the advantages (i.e. improved flow, higher COR values at equal hardness, increased clarity, etc.) produced by the Iotek 7520 resin when compared to the methacrylic acid base soft ionomers known in the art (such as the Surlyn 8625 and the Surlyn 8629 combinations disclosed in U.S. Pat. No. 4,884,814).

In addition, Iotek 7510, when compared to Iotek 7520, produces slightly higher COR values at equal softness/hardness due to the Iotek 7510's higher hardness and neutralization. Similarly, Iotek 7510 produces better release properties (from the mold cavities) due to its slightly higher stiffness and lower flow rate than Iotek 7520. This is important in production where the soft covered balls tend to have lower yields caused by sticking in the molds and subsequent punched pin marks from the knockouts.

According to Exxon, Iotek 7510 is of similar chemical composition as Iotek 7520 (i.e. a zinc salt of a terpolymer of ethylene, acrylic acid, and methyl acrylate) but is more highly neutralized. Based upon FTIR analysis, Iotek 7520 is estimated to be about 30–40 weight percent neutralized and Iotek 7510 is estimated to be about 40–60 weight percent neutralized. The typical properties of Iotek 7510 in comparison with those of Iotek 7520 are set forth below:

TABLE 4

Physical Properties of Iotek 7510 in Comparison to Iotek 7520

| | IOTEK 7520 | IOTEK 7510 |
|---|---|---|
| MI, g/10 min | 2.0 | 0.8 |
| Density, g/cc | 0.96 | 0.97 |
| Melting Point, ° F. | 151 | 149 |
| Vicat Softening Point, ° F. | 108 | 109 |
| Flex Modulus, psi | 3800 | 5300 |
| Tensile Strength, psi | 1450 | 1750 |
| Elongation, % | 760 | 690 |
| Hardness, Shore D | 32 | 35 |

It has been determined that when hard/soft ionomer blends are used for the outer cover layer, good results are achieved when the relative combination is in a range of about 90 to about 10 percent hard ionomer and about 10 to about 90 percent soft ionomer. The results are improved by adjusting the range to about 75 to 25 percent hard ionomer and 25 to 75 percent soft ionomer. Even better results are noted at relative ranges of about 60 to 90 percent hard ionomer resin and about 40 to 60 percent soft ionomer resin.

Specific formulations which may be used in the cover composition are included in the examples set forth in U.S. Pat. Nos. 5,120,791 and 4,884,814. The present invention is in no way limited to those examples. It will be understood that ionomer compositions containing about 16 weight percent acid may be referred to as either low acid or high acid. However, for purposes herein, such compositions are generally considered to be low acid.

Moreover, in alternative embodiments, the outer cover layer formulation may also comprise a soft, low modulus non-ionomeric thermoplastic elastomer including a polyes ter polyurethane such as B. F. Goodrich Company's Estane® polyester polyurethane X-4517. According to B. F. Goodrich, Estane® X-4517 has the following properties:

TABLE 5

| Properties of Estane ® X-4517 | |
|---|---|
| Tensile | 1430 |
| 100% | 815 |
| 200% | 1024 |
| 300% | 1193 |
| Elongation | 641 |
| Youngs Modulus | 1826 |
| Hardness A/D | 88/39 |
| Bayshore Rebound | 59 |
| Solubility in Water | Insoluble |
| Melt processing temperature | >350° F. (>177° C.) |
| Specific Gravity ($H_2O$ = 1) | 1.1–1.3 |

Other soft, relatively low modulus non-ionomeric thermoplastic elastomers may also be utilized to produce the outer cover layer as long as the non-ionomeric thermoplastic elastomers produce the playability and durability characteristics desired without adversely effecting the enhanced travel distance characteristic produced by the high acid ionomer resin composition. These include, but are not limited to thermoplastic polyurethanes such as: Texin thermoplastic polyurethanes from Mobay Chemical Co. and the Pellethane thermoplastic polyurethanes from Dow Chemical Co.; Ionomer/rubber blends such as those in Spalding U.S. Pat. Nos. 4,986,545; 5,098,105 and 5,187,013; and, Hytrel polyester elastomers from DuPont and Pebax polyester amides from Elf Atochem S.A.

In addition, or instead of the following thermoplastics, one or more thermoset polymeric materials may be utilized for the outer cover. Preferred thermoset polymeric materials include, but are not limited to, polyurethanes, metallocenes, diene rubbers such as cis 1,4 polybutadiene, trans polyisoprene EDPM or EPR. It is also preferred that all thermoset materials be crosslinked. Crosslinking may be achieved by chemical crosslinking and/or initiated by free radicals generated from peroxides, gamma or election beam radiation.

The polymeric outer cover layer is about 0.020 inches to about 0.120 inches in thickness. The outer cover layer is preferably about 0.050 inches to about 0.075 inches in thickness. Together, the mantle and the outer cover layer combine to form a ball having a diameter of 1.680 inches or more, the minimum diameter permitted by the rules of the United States Golf Association and weighing about 1.620 ounces.

Mantle

The preferred embodiment golf balls of the present invention comprise one or more mantle layers disposed inwardly and proximate to, and preferably adjacent to, the outer cover layer. The mantle layer(s) may be formed from metal, ceramic, or composite materials. Regarding metals, a wide array of metals can be used in the mantle layers or shells as described herein. Table 6, set forth below, lists suitable metals for use in the preferred embodiment golf balls.

TABLE 6

Metals for Use in Mantle Layer(s)

| Metal | Young's modulus, E, $10^6$ psi | Bulk modulus, K, $10^6$ psi | Shear modulus, G, $10^6$ psi | Poisson's ratio, v |
|---|---|---|---|---|
| Aluminum | 10.2 | 10.9 | 3.80 | 0.345 |
| Brass, 30 Zn | 14.6 | 16.2 | 5.41 | 0.350 |
| Chromium | 40.5 | 23.2 | 16.7 | 0.210 |
| Copper | 18.8 | 20.0 | 7.01 | 0.343 |
| Iron | | | | |
| (soft) | 30.7 | 24.6 | 11.8 | 0.293 |
| (cast) | 22.1 | 15.9 | 8.7 | 0.27 |
| Lead | 2.34 | 6.64 | 0.811 | 0.44 |
| Magnesium | 6.48 | 5.16 | 2.51 | 0.291 |
| Molybdenum | 47.1 | 37.9 | 18.2 | 0.293 |
| Nickel | | | | |
| (soft) | 28.9 | 25.7 | 11.0 | 0.312 |
| (hard) | 31.8 | 27.2 | 12.2 | 0.306 |
| Nickel-silver, 55Cu—18Ni—27Zn | 19.2 | 19.1 | 4.97 | 0.333 |
| Niobium | 15.2 | 24.7 | 5.44 | 0.397 |
| Silver | 12.0 | 15.0 | 4.39 | 0.367 |
| Steel, mild | 30.7 | 24.5 | 11.9 | 0.291 |
| Steel, 0.75 C | 30.5 | 24.5 | 11.8 | 0.293 |
| Steel, 0.75 C, hardened | 29.2 | 23.9 | 11.3 | 0.296 |
| Steel, tool | 30.7 | 24.0 | 11.9 | 0.287 |
| Steel, tool, hardened | 29.5 | 24.0 | 11.4 | 0.295 |
| Steel, stainless, 2Ni—18Cr | 31.2 | 24.1 | 12.2 | 0.283 |
| Tantalum | 26.9 | 28.5 | 10.0 | 0.342 |
| Tin | 7.24 | 8.44 | 2.67 | 0.357 |
| Titanium | 17.4 | 15.7 | 6.61 | 0.361 |
| Titanium/ Nickel alloy | | | | |
| Tungsten | 59.6 | 45.1 | 23.3 | 0.280 |
| Vanadium | 18.5 | 22.9 | 6.77 | 0.365 |
| Zinc | 15.2 | 10.1 | 6.08 | 0.249 |

Preferably, the metals used in the one or more mantle layers are steel, titanium, chromium, nickel, or alloys thereof. Generally, it is preferred that the metal selected for use in the mantle be relatively stiff, hard, dense, and have a relatively high modulus of elasticity.

The thickness of the metal mantle layer depends upon the density of the metals used in that layer, or if a plurality of metal mantle layers are used, the densities of those metals in other layers within the mantle. Typically, the thickness of the mantle ranges from about 0.001 inches to about 0.050 inches. The preferred thickness for the mantle is from about 0.005 inches to about 0.050 inches. The most preferred range is from about 0.005 inches to about 0.010 inches. It is preferred that the thickness of the mantle be uniform and constant at all points across the mantle.

As noted, the thickness of the metal mantle depends upon the density of the metal(s) utilized in the one or more mantle layers. Table 7, set forth below, lists typical densities for the preferred metals for use in the mantle.

TABLE 7

| Metal | Density (grams per cubic centimeter) |
|---|---|
| Chromium | 6.46 |
| Nickel | 7.90 |
| Steel (approximate) | 7.70 |
| Titanium | 4.13 |

There are at least two approaches in forming a metal mantle utilized in the preferred embodiment golf balls. In a first embodiment, two metal half shells are stamped from metal sheet stock. The two half shells are then arc welded together and heat treated to stress relieve. It is preferred to heat treat the resulting assembly since welding will typically anneal and soften the resulting hollow sphere resulting in "oil canning," i.e. deformation of the metal sphere after impact, such as may occur during play.

In a second embodiment, a metal mantle is formed via electroplating over a thin hollow polymeric sphere, described in greater detail below. This polymeric sphere may correspond to the previously described optional polymeric hollow sphere substrate 30. There are several preferred techniques by which a metallic mantle layer may be deposited upon a non-metallic substrate. In a first category of techniques, an electrically conductive layer is formed or deposited upon the polymeric or non-metallic sphere. Electroplating may be used to fully deposit a metal layer after a conductive salt solution is applied onto the surface of the non-metallic substrate. Alternatively, or in addition, a thin electrically conducting metallic surface can be formed by flash vacuum metallization of a metal agent, such as aluminum, onto the substrate of interest. Such surfaces are typically about $3\times10^{-6}$ of an inch thick. Once deposited, electroplating can be utilized to form the metal layer(s) of interest. It is contemplated that vacuum metallization could be employed to fully deposit the desired metal layer(s). Yet another technique for forming an electrically conductive metal base layer is chemical deposition. Copper, nickel, or silver, for example, may be readily deposited upon a non-metallic surface. Yet another technique for imparting electrical conductivity to the surface of a non-metallic substrate is to incorporate an effective amount of electrically conductive particles in the substrate, such as carbon black, prior to molding. Once having formed an electrically conductive surface, electroplating processes can be used to form the desired metal mantle layers.

Alternatively, or in addition, various thermal spray coating techniques can be utilized to form one or more metal mantle layers onto a spherical substrate. Thermal spray is a generic term generally used to refer to processes for depositing metallic and non-metallic coatings, sometimes known as metallizing, that comprise the plasma arc spray, electric arc spray, and flame spray processes. Coatings can be sprayed from rod or wire stock, or from powdered material.

A typical plasma arc spray system utilizes a plasma arc spray gun at which one or more gasses are energized to a highly energized state, i.e. a plasma, and are then discharged typically under high pressures toward the substrate of interest. The power level, pressure, and flow of the arc gasses, and the rate of flow of powder and carrier gas are typically control variables.

The electric arc spray process preferably utilizes metal in wire form. This process differs from the other thermal spray processes in that there is no external heat source, such as from a gas flame or electrically induced plasma. Heating and melting occur when two electrically opposed charged wires, comprising the spray material, are fed together in such a manner that a controlled arc occurs at the intersection. The molten metal is atomized and propelled onto a prepared substrate by a stream of compressed air or gas.

The flame spray process utilizes combustible gas as a heat source to melt the coating material. Flame spray guns are available to spray materials in rod, wire, or powder form. Most flame spray guns can be adapted for use with several combinations of gases. Acetylene, propane, mapp gas, and oxygen-hydrogen are commonly used flame spray gases.

Another process or technique for depositing a metal mantle layer onto a spherical substrate in the preferred embodiment golf balls is chemical vapor deposition (CVD). In the CVD process, a reactant atmosphere is fed into a processing chamber where it decomposes at the surface of the substrate of interest, liberating one material for either absorption by or accumulation on the work piece or substrate. A second material is liberated in gas form and is removed from the processing chamber, along with excess atmosphere gas, as a mixture referred to as off-gas.

The reactant atmosphere that is typically used in CVD includes chlorides, fluorides, bromides and iodides, as well as carbonyls, organometallics, hydrides and hydrocarbons. Hydrogen is often included as a reducing agent. The reactant atmosphere must be reasonably stable until it reaches the substrate, where reaction occurs with reasonably efficient conversion of the reactant. Sometimes it is necessary to heat the reactant to produce the gaseous atmosphere. A few reactions for deposition occur at substrate temperatures below 200 degrees C. Some organometallic compounds deposit at temperatures of 600 degrees C. Most reactions and reaction products require temperatures above 800 degrees C.

Common CVD coatings include nickel, tungsten, chromium, and titanium carbide. CVD nickel is generally separated from a nickel carbonyl, $Ni(CO)_4$, atmosphere. The properties of the deposited nickel are equivalent to those of sulfonate nickel deposited electrolytically. Tungsten is deposited by thermal decomposition of tungsten carbonyl at 300 to 600 degrees C., or may be deposited by hydrogen reduction of tungsten hexachloride at 700 to 900 degrees C. The most convenient and most widely used reaction is the hydrogen reduction of tungsten hexafluoride. If depositing chromium upon an existing metal layer, this may be done by pack cementation, a process similar to pack carbonizing, or by a dynamic, flow-through CVD process. Titanium carbide coatings may be formed by the hydrogen reduction of titanium tetrafluoride in the presence of methane or some other hydrocarbon. The substrate temperatures typically range from 900 to 1010 degrees C., depending on the substrate.

Surface preparation for CVD coatings generally involve de-greasing or grit blasting. In addition, a CVD pre-coating treatment may be given. The rate of deposition from CVD reactions generally increases with temperature in a manner specific to each reaction. Deposition at the highest possible rate is preferable, however, there are limitations which require a processing compromise.

Vacuum coating is another category of processes for depositing metals and metal compounds from a source in a high vacuum environment onto a substrate, such as the spherical substrate used in several of the preferred embodiment golf balls. Three principal techniques are used to accomplish such deposition: evaporation, ion plating, and sputtering. In each technique, the transport of vapor is carried out in an evacuated, controlled environment chamber and, typically, at a residual air pressure of 1 to $10^{-5}$ Pascals.

In the evaporation process, vapor is generated by heating a source material to a temperature such that the vapor pressure significantly exceeds the ambient chamber pressure and produces sufficient vapor for practical deposition. To coat the entire surface of a substrate, such as the inner spherical substrate utilized in the preferred embodiment golf balls, it must be rotated and translated over the vapor source. Deposits made on substrates positioned at low angles to the vapor source generally result in fibrous, poorly bonded structures. Deposits resulting from excessive gas scattering are poorly adherent, amorphous, and generally dark in color. The highest quality deposits are made on surfaces nearly normal or perpendicular to the vapor flux. Such deposits faithfully reproduce the substrate surface texture. Highly polished substrates produce lustrous deposits, and the bulk properties of the deposits are maximized for the given deposition conditions.

For most deposition rates, source material should be heated to a temperature so that its vapor pressure is at least 1 Pascal or higher. Deposition rates for evaporating bulk vacuum coatings can be very high. Commercial coating equipment can deposit up to 500,000 angstroms of material thickness per minute using large ingot material sources and high powered electron beam heating techniques.

As indicated, the directionality of evaporating atoms from a vapor source generally requires the substrate to be articulated within the vapor cloud. To obtain a specific film distribution on a substrate, the shape of the object, the arrangement of the vapor source relative to the component surfaces, and the nature of the evaporation source may be controlled.

Concerning evaporation sources, most elemental metals, semi-conductors, compounds, and many alloys can be directly evaporated in vacuum. The simplest sources are resistance wires and metal foils. They are generally constructed of refractory metals, such as tungsten, molybdenum, and tantalum. The filaments serve the dual function of heating and holding the material for evaporation. Some elements serve as sublimation sources such as chromium, palladium, molybdenum, vanadium, iron, and silicon, since they can be evaporated directly from the solid phase. Crucible sources comprise the greatest applications in high volume production for evaporating refractory metals and compounds. The crucible materials are usually refractory metals, oxides, and nitrides, and carbon. Heating can be accomplished by radiation from a second refractory heating element, by a combination of radiation and conduction, and by radial frequency induction heating.

Several techniques are known for achieving evaporation of the evaporation source. Electron beam heating provides a flexible heating method that can concentrate heat on the evaporant. Portions of the evaporant next to the container can be kept at low temperatures, thus minimizing interaction. Two principal electron guns in use are the linear focusing gun, which uses magnetic and electrostatic focusing methods, and the bent-beam magnetically focused gun. Another technique for achieving evaporation is continuous feed high rate evaporation methods. High rate evaporation of alloys to form film thicknesses of 100 to 150 micrometers requires electron beam heating sources in large quantities of evaporant. Electron beams of 45 kilowatts or higher are used to melt evaporants in water cooled copper hearths up to 150 by 400 millimeters in cross section.

Concerning the substrate material of the spherical shell upon which one or more metal layers are formed in the preferred embodiment golf balls, the primary requirement of the material to be coated is that it be stable in vacuum. It must not evolve gas or vapor when exposed to the metal vapor. Gas evolution may result from release of gas absorbed on the surface, release of gas trapped in the pores of a porous substrate, evolution of a material such as plasticizers used in plastics, or actual vaporization of an ingredient in the substrate material.

In addition to the foregoing methods, sputtering may be used to deposit one or more metal layers onto, for instance, an inner hollow sphere substrate such as substrate 30 utilized in the preferred embodiment golf balls. Sputtering is a process wherein material is ejected from the surface of a solid or liquid because of a momentum exchange associated with bombardment by energetic particles. The bombarding species are generally ions of a heavy inert gas. Argon is most commonly used. The source of ions may be an ion beam or a plasma discharge into which the material can be bombarded is immersed.

In the plasma-discharge sputter coating process, a source of coating material called a target is placed in a vacuum chamber which is evacuated and then back filled with a working gas, such as Argon, to a pressure adequate to sustain the plasma discharge. A negative bias is then applied to the target so that it is bombarded by positive ions from the plasma.

Sputter coating chambers are typically evacuated to pressures ranging from 0.001 to 0.00001 Pascals before back filling with Argon to pressures of 0.1 to 10 Pascals. The intensity of the plasma discharge, and thus the ion flux and sputtering rate that can be achieved, depends on the shape of the cathode electrode, and on the effective use of a magnetic field to confine the plasma electrons. The deposition rate in sputtering depends on the target sputtering rate and the apparatus geometry. It also depends on the working gas pressure, since high pressures limit the passage of sputtered flux to the substrates.

Ion plating may also be used to form one or more metal mantle layers in the golf balls of the present invention. Ion plating is a generic term applied to atomistic film deposition processes in which the substrate surface and/or the depositing film is subjected to a flux of high energy particles (usually gas ions) sufficient to cause changes in the interfacial region or film properties. Such changes may be in the film adhesion to the substrate, film morphology, film density, film stress, or surface coverage by the depositing film material.

Ion plating is typically done in an inert gas discharge system similar to that used in sputtering deposition except that the substrate is the sputtering cathode and the bombarded surface often has a complex geometry. Basically, the ion plating apparatus is comprised of a vacuum chamber and a pumping system, which is typical of any conventional vacuum deposition unit. There is also a film atom vapor source and an inert gas inlet. For a conductive sample, the work piece is the high voltage electrode, which is insulated from the surrounding system. In the more generalized situation, a work piece holder is the high voltage electrode and either conductive or non-conductive materials for plating are attached to it. Once the specimen to be plated is attached to the high voltage electrode or holder and the filament vaporization source is loaded with the coating material, the system is closed and the chamber is pumped down to a pressure in the range of 0.001 to 0.0001 Pascals. When a desirable vacuum has been achieved, the chamber is back filled with Argon to a pressure of approximately 1 to 0.1 Pascals. An electrical potential of −3 to −5 kilovolts is then introduced across the high voltage electrode, that is the specimen or specimen holder, and the ground for the system. Glow discharge occurs between the electrodes which results in the specimen being bombarded by the high energy Argon ions produced in the discharge, which is equivalent to direct current sputtering. The coating source is then energized and the coating material is vaporized into the glow discharge.

Another class of materials, contemplated for use in forming the one or more metal mantle layers is nickel titanium alloys. These alloys are known to have super elastic properties and are approximately 50 percent (atomic) nickel and 50 percent titanium. When stressed, a super elastic nickel titanium alloy can accommodate strain deformations of up to 8 percent. When the stress is later released, the super elastic component returns to its original shape. Other shape memory alloys can also be utilized including alloys of copper zinc aluminum, and copper aluminum nickel. Table 8 set forth below presents various physical, mechanical, and transformation properties of these three preferred shape memory alloys.

TABLE 8

Properties of Shape Memory Alloys for Use in Mantle Layer(s)

| | Cu—Zn—Al | Cu—Al—Ni | Ni—Ti |
|---|---|---|---|
| PHYSICAL PROPERTIES | | | |
| Density (g/cm$^3$) | 7.64 | 7.12 | 6.5 |
| Resistivity ($\mu\Omega$-cm) | 8.5–9.7 | 11–13 | 80–100 |
| Thermal Conductivity (J/m-s-K) | 120 | 30–43 | 10 |
| Heat Capacity (J/Kg-K) | 400 | 373–574 | 390 |
| MECHANICAL PROPERTIES | | | |
| Young's Modulus (GPa) | | | |
| β-Phase | 72 | 85 | 83 |
| Martensite | 70 | 80 | 34 |
| Yield Strength (MPa) | | | |
| β-Phase | 350 | 400 | 690 |
| Martensite | 80 | 130 | 70–150 |
| Ultimate Tensile Strength (Mpa) | 600 | 500–800 | 900 |
| TRANSFORMATION PROPERTIES | | | |
| Heat of Transformation (J/mole) | | | |
| Martensite | 160–440 | 310–470 | |
| R-Phase | | | 55 |
| Hysteresis (K) | | | |
| Martensite | 10–25 | 15–20 | 30–40 |
| R-Phase | | | 2–5 |
| Recoverable Strain (%) | | | |
| One-Way (Martensite) | 4 | 4 | 8 |
| One-Way (R-Phase) | | | 0.5–1 |
| Two-Way (Martensite) | 2 | 2 | 3 |

As noted, the previously-described mantle may also comprise one or more ceramic or vitreous materials. Preferred ceramics include, but are not limited to, silica, soda lime, lead silicate, borosilicate, aluminoborosilicate, aluminosilicate, and various glass ceramics. Specifically, a wide array of ceramic materials can be utilized in the ceramic mantle layer. Table 9 set forth below provides a listing of suitable ceramic materials.

TABLE 9

Ceramics for Use in Mantle Layer(s)

| Material | Modulus of rupture, MPa |
|---|---|
| aluminum oxide crystals | 345–1034 |
| sintered alumina (ca 5% porosity) | 207–345 |
| alumina porcelain (90–95% $Al_2O_3$) | 345 |
| sintered beryllia (ca 5% porosity) | 138–276 |
| hot-pressed boron nitride (ca 5% porosity) | 48–103 |
| hot-pressed boron carbide (ca 5% porosity) | 345 |
| sintered magnesia (ca 5% porosity) | 103 |
| sintered molybdenum silicide (ca 5% porosity) | 690 |
| sintered spinel (ca 5% porosity) | 90 |
| dense silicon carbide (ca 5% porosity) | 172 |
| sintered titanium carbide (ca 5% porosity) | 1100 |
| sintered stabilized zirconia (ca 5% porosity) | 83 |
| silica glass | 107 |
| vycor glass | 69 |
| pyrex glass | 69 |
| mullite porcelain | 69 |
| steatite porcelain | 138 |
| superduty fire-clay brick | 5.2 |
| magnesite brick | 27.6 |
| bonded silicon carbide (ca 20% porosity) | 13.8 |
| 1090° C. insulating firebrick (80–85% porosity) | 0.28 |
| 1430° C. insulating firebrick (ca 75% porosity) | 1.17 |
| 1650° C. insulating firebrick (ca 60% porosity) | 2.0 |

It is also preferred to utilize a ceramic matrix composite material such as, for example, various ceramics that are reinforced with silicon carbide fibers or whiskers. Table 10, set forth below, lists properties of typical silicon carbide reinforced ceramics.

TABLE 10

SiC Reinforced Ceramics for Use in Mantle Layer(s)

| Matrix | Reinforcement/ vol % | Fracture toughness (ksi inches)½ | Flexural strength (ksi) |
|---|---|---|---|
| Barium Osumilite | SiC whiskers/25 | 4.1 | 50–60 |
| Corning 1723 Glass | SiC whiskers/25 | 1.9–3.1 | 30–50 |
| Cordierite | SiC whiskers/20 | 3.4 | 40 |
| $MoSi_2$ | SiC whiskers/20 | 7.5 | 45 |
| Mullite | SiC whiskers/20 | 4.2 | 65 |
| $Si_3N_4$ | SiC whiskers/10 | 5.9–8.6 | 60–75 |
| $Si_3N_4$ | SiC whiskers/30 | 6.8–9.1 | 50–65 |
| Spinel | SiC whiskers/30 | — | 60 |
| Toughened $Al_2O_3$ | SiC whiskers/20 | 7.7–12.3 | 100–130 |

It is also preferred to provide a ceramic matrix of aluminum oxide, $Al_2O_3$, reinforced with silicon carbide fibers or whiskers. Typical properties of such a reinforced matrix are set forth below in Table 11.

TABLE 11

SiC Reinforced $Al_2O_3$ Ceramics for Use in Mantle Layer(s)

| Reinforcement/vol % | Fracture strength (ksi) | Fracture toughness (ksi inches)½ | Test temperature |
|---|---|---|---|
| SiC whiskers/10 | 65 | 6.5 | RT |
| SiC whiskers/10 | 45 | — | 1830° F. |
| SiC whiskers/20 | 95 | 6.8–8.2 | RT |
| SiC whiskers/20 | 85 | 6.4–7.3 | 1830° F. |
| SiC whiskers/40 | 120 | 5.5 | RT |
| SiC whiskers/40 | 96 | 5.6 | 1830° F. |

Yet another preferred embodiment for the ceramic composite mantle is the use of a multidirectional continuous ceramic fiber dispersed within a ceramic composite. Typical properties of such substrates are set forth in Table 12 below.

TABLE 12

Multidirectional Continuous Ceramic Fibers in Ceramic Composite for Use in Mantle Layer(s)

| Material/properties | $SiO_2$/ $SiO_2$3-D | $Al_2O_3$/ $Al_2O_3$3-D | $Al_2O_3$/ $SiO_2$3-D | BN/Bn3-D |
|---|---|---|---|---|
| Reinforcement/(vol %) | $SiO_2$/50 | $Al_2O_3$/30 | $Al_2O_3$/30 | BN/40 |
| ($10^3$ psi) | | | | |
| Tensile strength | 3.87 | 10.3 | 10.8 | 3.6 |
| Tensile modulus ($10^6$ psi) | 2.26 | 5.26 | 4.90 | 2.23 |
| Compressive strength ($10^3$ psi) | 21.0 | 32.6 | — | 5.29 |
| Compressive modulus ($10^6$ psi) | 3.18 | 4.55 | — | 4.23 |
| Thermal conductivity (BTU/hr/ft$^2$/° F./in) | 4.6 | 11.2 | 4.7 | 62.4 |
| Density (g/cm$^3$) | 1.6 | 1.9 | 2.0 | 1.6 |

In forming the ceramic mantle, two approaches are primarily used. In a first preferred method, two ceramic half shells are formed. Each half shell utilizes a tongue and groove area along its bond interface region to improve bond strength. The shells are then adhesively bonded to one another by the use of one or more suitable adhesives known in the art.

In a second preferred method, a ceramic mantle layer is deposited over a core such as the core 40, or hollow spherical substrate such as the substrate 30, both of which are described in greater detail below, by one of several deposition techniques. If a composite matrix utilizing fibers is to be formed, the fibers, if continuous, can be applied by winding the single or multi-strands onto the core or hollow spherical substrate, in either a wet or dry state. Using the wet method, the strand or strands pass through an epoxy resin bath prior to their winding around the core of the golf ball to a specific diameter. Either during or subsequent to winding, the wound core is compression molded using heat and moderate pressure in smooth spherical cavities. After de-molding, a dimpled cover is molded around the wound center using compression, injection, or transfer molding techniques. The ball is then trimmed, surface treated, stamped, and clear coated.

If the ceramic mantle layer is formed by a dry technique, the epoxy resin, such as in the dipping bath if the previously described wet method is used, can be impregnated into the fibers and molded as described above.

If the fiber is discontinuous, it can be applied to the core by simultaneously spraying a chopped fiber and a liquid epoxy resin to a revolving core or spherical substrate. The wet, wound center is then cured by molding as previously described.

With regard to the use of discontinuous fibers, the critical factors are the length to diameter ratio of the fiber, the shear strength of the bond between the fiber and the matrix, and the amount of fiber. All of these variables effect the overall strength of the composite mantle.

The thickness of the ceramic mantle typically ranges from about 0.001 inch to about 0.070 inch. The preferred thickness ranges from about 0.005 inch to about 0.040 inch. The most preferred range is from about 0.010 inch to about 0.020 inch.

As the thickness of the ceramic layer increases, the weight and stiffness generally increases, and therefore, the PGA compression will also increase. This is typically the limiting factor, that is the PGA compression. Ball compressions over 110 PGA are generally undesirable. PGA compressions under 40 PGA are typically too soft. The overall ball compression can be adjusted by modifying or tailoring the core compression, i.e., a soft core requires a relatively thick mantle and a hard core requires a thin mantle but within the thicknesses described previously.

As noted, the mantle may comprise a ceramic composite material. In addition to dispersing glass and/or carbon fibers within various matrix materials, such as ceramics, epoxy, thermoset, and thermoplastics, other preferred fibers include boron carbide. It is also contemplated to utilize aramid (Kevlar), cotton, flax, jute, hemp, and silk fibers. The most preferred non-ceramic fibers are carbon, glass, and aramid fibers.

Typical properties for fibers suitable for forming reinforced materials are set forth below in Tables 13 and 14.

TABLE 13

Reinforced Composite Materials for Use in Mantle Layer(s)

| Fiber | Density (g/cm$^3$) | Tensile strength GPa | Tensile strength ksi | Tensile modulus GPa | Tensile modulus $10^6$ psi |
|---|---|---|---|---|---|
| E-Glass | 2.58 | 3.45 | 500 | 72.5 | 10.5 |
| A-Glass | 2.50 | 3.04 | 440 | 69.0 | 10.0 |
| ECR-Glass | 2.62 | 3.63 | 525 | 72.5 | 10.5 |
| S-Glass | 2.48 | 4.59 | 665 | 86.0 | 12.5 |

TABLE 14

Reinforced Composite Materials for Use in Mantle Layer(s)

| Fiber | Precursor type | Density (g/cm$^3$) | Tensile strength GPa | Tensile strength ksi | Tensile modulus GPa | Tensile modulus $10^6$ psi |
|---|---|---|---|---|---|---|
| AS-4 | PAN | 1.78 | 4.0 | 580 | 231 | 33.5 |
| AS-6 | PAN | 1.82 | 4.5 | 652 | 245 | 35.5 |
| IM-6 | PAN | 1.74 | 4.8 | 696 | 296 | 42.9 |
| T300 | PAN | 1.75 | 3.31 | 480 | 228 | 32.1 |
| T500 | PAN | 1.78 | 3.65 | 530 | 234 | 34.0 |
| T700 | PAN | 1.80 | 4.48 | 650 | 248 | 36.0 |
| T-40 | PAN | 1.74 | 4.50 | 652 | 296 | 42.9 |
| Celion | PAN | 1.77 | 3.55 | 515 | 234 | 34.0 |
| Celion ST | PAN | 1.78 | 4.34 | 630 | 234 | 34.0 |
| XAS | PAN | 1.84 | 3.45 | 500 | 234 | 34.0 |
| HMS-4 | PAN | 1.78 | 3.10 | 450 | 338 | 49.0 |
| PAN 50 | PAN | 1.81 | 2.41 | 355 | 393 | 57.0 |
| HMS | PAN | 1.91 | 1.52 | 220 | 341 | 49.4 |
| G-50 | PAN | 1.78 | 2.48 | 360 | 359 | 52.0 |
| GY-70 | PAN | 1.96 | 1.52 | 220 | 483 | 70.0 |
| P-55 | Pitch | 2.0 | 1.73 | 250 | 379 | 55.0 |
| P-75 | Pitch | 2.0 | 2.07 | 300 | 517 | 75.0 |
| P-100 | Pitch | 2.15 | 2.24 | 325 | 724 | 100 |
| HMG-50 | Rayon | 1.9 | 2.07 | 300 | 345 | 50.0 |
| Thornel 75 | Rayon | 1.9 | 2.52 | 365 | 517 | 75.0 |

It is to be understood that one or more of these fibers could be utilized in a ceramic, epoxy, thermoset, and/or thermoplastic matrix material in forming the mantle layer(s). Details of suitable epoxy, thermoset, and thermoplastic materials are set forth below.

The composite mantle may also be formed from various epoxy molding compounds including, for example, carbon or glass fibers dispersed within an epoxy matrix. Table 15, set forth below, lists typical properties of such epoxy molding compounds.

TABLE 15

| Reinforced Epoxy Based Composite Materials for Use in Mantle Layer(s) | | | | | |
|---|---|---|---|---|---|
| Material/ Properties Matrix Reinforcement/(vol %) | Epoxy Glass/60 | Epoxy Carbon/60 | Epoxy HS carbon/60 | Epoxy HM carbon/60 | Epoxy Short-glass/60 |
| Density ($g/cm^3$) | 1.86–1.92 | 1.48–1.54 | 1.48–1.54 | 1.48–1.54 | 1.78–1.83 |
| Tensile strength ($10^3$ psi) | 35 | 30 | 32 | 18 | 11 |
| Tensile modulus ($10^6$ psi) | — | — | — | — | — |
| Flexural strength ($10^3$ psi) | 85 | 54 | 58 | 53 | 18 |
| Flexural modulus ($10^6$ psi) | 4.2 | 7.2 | 8.2 | 11.8 | 2.0 |
| Compressive strength ($10^3$ psi) | 42 | 36 | 44 | 31 | 28 |
| Izod impact notched (ft lb/in.) | 45 | 20 | 25 | 15 | 0.70 |
| Coeff thermal expansion ($10^{-6}$/° F.) | 14 | 1.0 | 1.0 | 1.0 | 27 |
| Conductivity (BTU/hr/$ft^2$/° F./in.) | 0.02 | — | — | — | 0.02 |
| Heat deflection temp 264 psi (° F.) | 250 | 250 | 250 | 250 | 154 |
| Flammability rating, UL | — | — | — | — | 94V-1 |
| Volume resistivity (ohm-cm) | $7.5 \times 10^{14}$ | — | — | — | $9 \times 10^{15}$ |
| Water absorption, 24 hr (%) | 0.10 | 0.20 | 0.20 | 0.20 | 0.10 |

The composite mantle layer may also be formed from a composite material of glass fibers dispersed within a thermoset matrix wherein the thermoset matrix is, for example, a polyimide material, silicone, vinyl ester, polyester, or melamine. Table 16, set forth below, lists typical properties of such composite thermoset molding materials.

TABLE 16

| Reinforced Thermoset Composite Materials for Use in Mantle Layer(s) | | | | | |
|---|---|---|---|---|---|
| Material/ Properties Matrix Reinforcement/(vol %) | Polyimide Glass/60 | Silicone Glass/60 | Vinyl ester Glass/60 | Polyester Glass/60 | Melamine Glass/60 |
| Density ($g/cm^3$) | 1.95–2.00 | 2.00–2.05 | 1.84–1.90 | 1.84–1.90 | 1.79–1.84 |
| Tensile strength ($10^3$ psi) | 21 | 4.0 | 39.0 | 8.0 | 8.0 |
| Tensile modulus ($10^6$ psi) | — | — | — | — | — |
| Flexural strength ($10^3$ psi) | 37 | 10 | 70 | 20 | 14 |
| Flexural modulus ($10^6$ psi) | 3.1 | 2.0 | 2.8 | 2.2 | 2.2 |
| Compressive strength ($10^3$ psi) | 32 | 11 | 42 | 20 | 42 |
| Izod impact notched (ft lb/in.) | 22 | 5.0 | 40 | 12 | 0.50 |
| Coeff thermal expansion ($10^{-6}$/° F.) | 10 | 7.0 | 10 | — | 20 |
| Conductivity (BTU/hr/$ft^2$/° F./in.) | 0.018 | 0.011 | — | — | 0.022 |
| Heat deflection temp 264 psi (° F.) | 500 | 500 | 430 | 480 | 320 |
| Flammability rating, UL | — | 94V-0 | — | — | 94V-0 |
| Volume resistivity (ohm-cm) | $2.5 \times 10^{16}$ | — | — | — | — |
| Water absorption, 24 hr (%) | 0.30 | 0.15 | 0.15 | 0.15 | 0.15 |

The preferred embodiment composite mantle layer may also be formed from various nylon molding compounds including, for example, glass or carbon fibers dispersed within a nylon matrix. Table 17 lists typical properties of such composite nylon mantles.

TABLE 17

| Reinforced Nylon Composite Materials for use in Mantle Layer(s) | | | | | | |
|---|---|---|---|---|---|---|
| Material/ Properties Matrix Reinforcement/(vol %) | Nylon 6 Glass/ 20 | Nylon 6 Glass/ 40 | Nylon 6/6 Glass/ 40 | Nylon 6/10 Carbon/ 40 | Nylon 6/10 Glass/ 40 | Nylon 11 Glass/ 20 |
| Density ($g/cm^3$) | 1.27 | 1.46 | 1.46 | 1.33 | 1.40 | 1.18 |
| Tensile strength ($10^3$ psi) | 20 | 25 | 32 | 36 | 26.5 | 14 |
| Tensile modulus ($10^6$ psi) | 0.98 | 1.4 | 1.9 | 4.2 | 1.5 | 0.75 |
| Flexural strength ($10^3$ psi) | 23 | 31 | 40 | 52 | 38 | 17 |
| Flexural modulus ($10^6$ psi) | 0.70 | 1.3 | 1.7 | 3.4 | 1.3 | 0.53 |
| Compressive strength ($10^3$ psi) | 21 | 23 | 23 | 25 | 25 | 12.5 |

TABLE 17-continued

| Reinforced Nylon Composite Materials for use in Mantle Layer(s) | | | | | | |
|---|---|---|---|---|---|---|
| Material/ Properties Matrix Reinforcement/(vol %) | Nylon 6 Glass/ 20 | Nylon 6 Glass/ 40 | Nylon 6/6 Glass/ 40 | Nylon 6/10 Carbon/ 40 | Nylon 6/10 Glass/ 40 | Nylon 11 Glass/ 20 |
| Izod impact notched (ft lb/in.) | 1.3 | 2.5 | 2.6 | 1.6 | 3.3 | 1.4 |
| Coeff thermal expansion ($10^{-6}$/° F.) | 23 | 13 | 19 | 8.0 | 11 | 40 |
| Conductivity (BTU/hr/ft$^2$/° F./in.) | 3.0 | 3.6 | 3.6 | 8.0 | 3.8 | 2.6 |
| Heat deflection temp 264 psi (° F.) | 390 | 400 | 480 | 500 | 420 | 340 |
| Flammability rating, UL | HB | HB | HB | HB | HB | HB |
| Volume resistivity (ohm-cm) | $10^{14}$ | $10^{14}$ | $10^{14}$ | 30 | $10^{12}$ | $10^{13}$ |
| Water absorption, 24 hr (%) | 1.3 | 1.0 | 0.7 | 0.4 | 0.23 | 0.19 |

The composite mantle layer may also be formed from a styrenic molding material, such as comprising glass or carbon fibers dispersed within a styrene material including, for example, an acrylonitrile-butadiene-styrene (ABS), polystyrene (PS), styrene-acrylonitrile (SAN), or styrene-maleic anhydride (SMA). Table 18, set forth below, lists typical properties for such materials.

TABLE 18

| Reinforced Styrene-Based Composite Materials for Use in Mantle Layer(s) | | | | | | |
|---|---|---|---|---|---|---|
| Material/ Properties Matrix Reinforcement/(vol %) | ABS Glass/ 20 | ABS Glass/ 40 | ABS Carbon/ 40 | PS Glass/ 40 | SAN Glass/ 40 | SMA Glass/ 40 |
| Density (g/cm$^3$) | 1.18 | 1.38 | 1.24 | 1.38 | 1.40 | 1.40 |
| Tensile strength ($10^3$ psi) | 13 | 18 | 17 | 14 | 20 | 14 |
| Tensile modulus ($10^6$ psi) | 0.88 | 1.5 | 3.1 | 2.0 | 2.0 | 1.67 |
| Flexural strength ($10^3$ psi) | 17 | 21 | 25 | 19 | 24 | 22.5 |
| Flexural modulus ($10^6$ psi) | 0.80 | 1.3 | 2.8 | 1.6 | 1.8 | 1.37 |
| Compressive strength ($10^3$ psi) | 13.5 | 19 | 19 | 17.5 | 22.0 | — |
| Izod impact notched (ft lb/in.) | 1.4 | 1.2 | 1.0 | 1.1 | 1.1 | 1.5 |
| Coeff thermal expansion ($10^{-6}$/° F.) | 20 | 13 | 12 | 17 | 15.5 | — |

TABLE 18-continued

| Reinforced Styrene-Based Composite Materials for Use in Mantle Layer(s) | | | | | | |
|---|---|---|---|---|---|---|
| Material/ Properties Matrix Reinforcement/(vol %) | ABS Glass/ 20 | ABS Glass/ 40 | ABS Carbon/ 40 | PS Glass/ 40 | SAN Glass/ 40 | SMA Glass/ 40 |
| Conductivity (BTU/hr/ft$^2$/° F./in.) | 1.4 | 1.6 | 3.8 | 2.2 | 2.1 | — |
| Heat deflection temp 264 psi (° F.) | 220 | 240 | 240 | 210 | 217 | 250 |
| Flammability rating, UL | HB | HB | HB | HB | HB | HB |
| Volume resistivity (ohm-cm) | $10^{15}$ | $10^{15}$ | 30 | $10^{16}$ | $10^{16}$ | — |
| Water absorption, 24 hr (%) | 0.18 | 0.12 | 0.14 | 0.05 | 0.1 | 0.1 |

The preferred composite mantle may also be formed from a reinforced thermoplastic material, such as comprising glass fibers dispersed within acetal copolymer (AC), polycarbonate (PC), and/or liquid crystal polymer (LCP). Table 19, set forth below, lists typical properties for such materials.

TABLE 19

| Reinforced Thermoplastic Composite Materials for Use in Mantle Layer(s) | | | | |
|---|---|---|---|---|
| Material/ Properties Matrix Reinforcement/(vol %) | AC Glass/20 | AC Glass/40 | PC Glass/40 | LCP Glass/30 |
| Density (g/cm$^3$) | 1.55 | 1.74 | 1.52 | 1.57 |
| Tensile strength ($10^3$ psi) | 12 | 13 | 21 | 16–29 |
| Tensile modulus ($10^6$ psi) | 1.2 | 1.6 | 1.7 | 2.5–2.6 |
| Flexural strength ($10^3$ psi) | 16.5 | 17.0 | 26.0 | 25–36 |
| Flexural modulus ($10^6$ psi) | 0.9 | 1.3 | 1.4 | 2.1–2.5 |
| Compressive strength ($10^3$ psi) | 12 | 11 | 22 | — |
| Izod impact notched (ft lb/in.) | 0.9 | 0.9 | 2.2 | 1.0–2.5 |
| Coeff thermal expansion ($10^{-6}$/° F.) | 25 | 18 | 9.5 | — |
| Conductivity (BTU/hr/ft$^2$/° F./in.) | 2.0 | 2.3 | 2.4 | — |
| Heat deflection temp 264 psi (° F.) | 325 | 328 | 300 | 445–600 |
| Flammability rating, UL | HB | HB | V1 | — |
| Volume | $10^{14}$ | $10^{14}$ | $10^{16}$ | $10^{16}$ |

TABLE 19-continued

| Material/ Properties Matrix Reinforcement/(vol %) | Reinforced Thermoplastic Composite Materials for Use in Mantle Layer(s) | | | |
|---|---|---|---|---|
| | AC Glass/20 | AC Glass/40 | PC Glass/40 | LCP Glass/30 |
| resistivity (ohm-cm) | | | | |
| Water absorption, 24 hr (%) | 0.5 | 1.0 | 0.07 | — |

The preferred embodiment composite material may also be formed from one or more thermoplastic molding compounds such as, for example, high density polyethylene (HDPE), polypropylene (PP), polybutylene terephthalate (PBT), or polyethylene terephthalate (PET) and including fibers of mica or glass. Table 20, set forth below, lists typical properties for such materials.

TABLE 20

| Material/ Properties Matrix Reinforcement/(vol %) | Reinforced Thermoplastic Composite Materials for Use in Mantle Layer(s) | | | | | |
|---|---|---|---|---|---|---|
| | HDPE Glass/ 20 | HDPE Glass/ 40 | PP Glass/ 40 | PP Mica/40 | PBT Glass/ 40 | PET Glass/ 55 |
| Density (g/cm$^3$) | 1.10 | 1.28 | 1.23 | 1.26 | 1.63 | 1.80 |
| Tensile strength ($10^3$ psi) | 7.0 | 10 | 16 | 5.6 | 21.5 | 28.5 |
| Tensile modulus ($10^6$ psi) | 0.6 | 1.25 | 1.3 | 1.1 | 2.0 | 3.0 |
| Flexural strength ($10^3$ psi) | 9.0 | 12 | 19 | 9 | 30 | 43 |
| Flexural modulus ($10^6$ psi) | 0.55 | 1.0 | 0.9 | 1.0 | 1.5 | 2.6 |
| Compressive strength ($10^3$ psi) | 5.0 | 7.5 | 13.0 | 7.0 | 20.0 | 28.5 |
| Izod impact notched (ft lb/in.) | 1.2 | 1.4 | 2.0 | 0.5 | 1.8 | 1.9 |
| Coeff thermal expansion ($10^{-6}$/° F.) | 28 | 25 | 17.5 | 22 | 12 | 10 |
| Conductivity (BTU/hr/ft$^2$/° F./in.) | 2.3 | 2.7 | 2.45 | 2.2 | 1.5 | 2.3 |
| Heat deflection temp 264 psi (° F.) | 240 | 250 | 300 | 230 | 415 | 450 |
| Flammability rating, UL | HB | HB | HB | HB | HB | HB |
| Volume resistivity (ohm-cm) | $10^{16}$ | $10^{16}$ | $10^{15}$ | $10^{16}$ | $10^{16}$ | $10^{16}$ |
| Water absorption, 24 hr (%) | 0.01 | 0.022 | 0.06 | 0.03 | 0.08 | 0.04 |

The preferred embodiment composite mantle layer may also be formed from thermoplastic materials including various polyphenylenes such as polyphenylene ether (PPE), polyphenylene oxide (PPO), or polyphenylene sulfide (PPS) within which are dispersed fibers of glass or graphite. Typical properties of these materials are set forth below in Table 21.

TABLE 21

| Material/ Properties Matrix Reinforcement/(vol %) | Reinforced Thermoplastic Composite Materials for Use in Mantle Layer(s) | | | | |
|---|---|---|---|---|---|
| | PPE-PPO Glass/20 | PPE-PPO Graphite/ 20 | PPS Glass/20 | PPS Glass/40 | PPS Graphite/ 40 |
| Density (g/cm$^3$) | 1.21 | 1.20 | 1.49 | 1.67 | 1.46 |
| Tensile strength ($10^3$ psi) | 13.5 | 15.0 | 14.5 | 20.0 | 26.0 |
| Tensile modulus ($10^6$ psi) | 1.0 | 1.0 | 1.3 | 2.0 | 4.8 |
| Flexural strength ($10^3$ psi) | 17.5 | 20.0 | 19.0 | 30.0 | 40.0 |
| Flexural modulus ($10^6$ psi) | 0.75 | 0.98 | 1.3 | 1.6 | 4.1 |
| Compressive strength ($10^3$ psi) | — | 17.0 | 22.5 | 25.0 | 27.0 |
| Izod impact notched (ft lb/in.) | 2.0 | 1.6 | 1.4 | 1.4 | 1.2 |
| Coeff thermal expansion ($10^{-6}$/° F.) | 20 | 12 | 16 | 12 | 8.0 |
| Conductivity (BTU/hr/ft$^2$/° F./in.) | 1.1 | — | 2.1 | 2.2 | 3.3 |
| Heat deflection temp 264 psi (° F.) | 285 | 235 | 500 | 500 | 500 |
| Flammability rating, UL | HB | — | V0 | V0 | V0 |
| Volume resistivity (ohm-cm) | $10^{17}$ | 13.0 | $10^{16}$ | $10^{16}$ | 30 |
| Water absorption, 24 hr (%) | 0.06 | — | 0.02 | 0.02 | 0.02 |

Also preferred for the composite material are various polyaryl thermoplastic materials reinforced with glass fibers or carbon fibers. Table 22, set forth below, lists typical properties for such composite materials. It is to be noted that PAS is polyarylsulfone, PSF is Polysulfone, and PES is Polyethersulfone.

TABLE 22

| Material/ Properties Matrix Reinforcement/(vol %) | Reinforced Polyaryl Thermoplastic Materials for Use in Mantle Layer(s) | | | | | |
|---|---|---|---|---|---|---|
| | PAS Glass/ 20 | PSF Glass/ 20 | PSF Glass/ 40 | PSF Carbon/ 40 | PES Glass/ 40 | PES Carbon/ 40 |
| Density (g/cm$^3$) | 1.51 | 1.38 | 1.56 | 1.42 | 1.68 | 1.52 |

TABLE 22-continued

| Material/ Properties Matrix Reinforcement/(vol %) | Reinforced Polyaryl Thermoplastic Materials for Use in Mantle Layer(s) | | | | | |
|---|---|---|---|---|---|---|
| | PAS Glass/ 20 | PSF Glass/ 20 | PSF Glass/ 40 | PSF Carbon/ 40 | PES Glass/ 40 | PES Carbon/ 40 |
| Tensile strength ($10^3$ psi) | 19 | 15 | 19 | 26 | 23 | 31 |
| Tensile modulus ($10^6$ psi) | 1.0 | 0.88 | 1.7 | 3.0 | 2.0 | 3.5 |
| Flexural strength ($10^3$ psi) | 27 | 20 | 25 | 35 | 31 | 42 |
| Flexural modulus ($10^6$ psi) | 0.9 | 0.7 | 1.2 | 2.4 | 1.6 | 3.2 |
| Compressive strength ($10^3$ psi) | — | 19 | 24 | — | 22 | — |
| Izod impact notched (ft lb/in.) | 1.1 | 1.1 | 1.6 | 1.3 | 1.5 | 1.4 |
| Coeff thermal expansion ($10^{-6}$/° F.) | — | 17 | 13 | — | 14 | — |
| Conductivity (BTU/hr/ft$^2$/° F./in.) | — | 2.1 | 2.6 | — | 2.6 | — |
| Heat deflection temp 264 psi (° F.) | 405 | 360 | 365 | 365 | 420 | 420 |
| Flammability rating, UL | V0 | V1 | V0 | V1 | V0 | V0 |
| Volume resistivity (ohm-cm) | $10^{16}$ | $10^{15}$ | $10^{15}$ | 30 | $10^{16}$ | 30 |
| Water absorption, 24 hr (%) | 0.4 | 0.24 | 0.25 | 0.25 | 0.30 | 0.30 |

Other thermoplastic materials may be used for the composite mantle including reinforced polyetherimide (PEI), or polyether etherketone (PEEK), reinforced with glass or carbon fibers. Table 23, set forth below, lists typical properties for such materials.

TABLE 23

| Material/ Properties Matrix Reinforcement/(vol %) | Reinforced Thermoplastic Composite Materials for Use in Mantle Layer(s) | | | | |
|---|---|---|---|---|---|
| | PEI Glass/20 | PEI Glass/40 | PEI Carbon/40 | PEEK Glass/20 | PEEK Carbon/40 |
| Density (g/cm$^3$) | 1.41 | 1.59 | 1.44 | 1.46 | 1.46 |
| Tensile strength ($10^3$ psi) | 23 | 31 | 34 | 23 | 39 |
| Tensile modulus ($10^6$ psi) | 1.1 | 1.9 | 4.1 | 2.0 | 4.4 |
| Flexural strength ($10^3$ psi) | 32 | 43 | 48 | 36 | 54 |
| Flexural modulus ($10^6$ psi) | 0.95 | 1.6 | 3.2 | 1.1 | 3.2 |
| Compressive strength ($10^3$ psi) | 24 | 24.5 | — | — | — |
| Izod impact notched (ft lb/in.) | 1.6 | 2.1 | 1.2 | 1.5 | 1.7 |
| Coeff thermal expansion ($10^{-6}$/° F.) | 15 | 11 | — | 14 | — |
| Conductivity (BTU/hr/ft$^2$/° F./in.) | 1.7 | 1.8 | — | — | — |
| Heat deflection temp 264 psi (° F.) | 410 | 410 | 410 | 550 | 550 |
| Flammability rating, UL | V0 | V0 | V0 | V0 | V0 |
| Volume resistivity (ohm-cm) | $10^{16}$ | $10^{16}$ | $10^{12}$ | $10^{16}$ | 30 |
| Water absorption, 24 hr (%) | 0.21 | 0.18 | 0.18 | 0.12 | 0.12 |

The thickness of a composite polymeric material based mantle generally ranges from about 0.001 inch to about 0.100 inch. The most preferred range is from about 0.010 inch to about 0.030 inch.

In forming the mantle from a polymeric material, two approaches are primarily used. In a first preferred method, two rigid polymeric half shells are formed. Each half shell utilizes a tongue and groove area along its bond interface region to improve bond strength. The shells are then adhesively bonded to one another by the use of one or more suitable adhesives known in the art.

In a second preferred method, a polymeric mantle layer is deposited over a core such as the core 40, or hollow spherical substrate such as the substrate 30, both of which are described in greater detail below, by one of several deposition techniques. If a composite matrix utilizing fibers is to be formed, the fibers, if continuous, can be applied by winding the single or multi-strands onto the core or hollow spherical substrate, in either a wet or dry state. Using the wet method, the strand or strands pass through an epoxy or other suitable resin bath prior to their winding around the core of the golf ball to a specific diameter. Either during or subsequent to winding, the wound core is compression molded using heat and moderate pressure in smooth spherical cavities. After de-molding, a dimpled cover is molded around the wound center using compression, injection, or transfer molding techniques. The ball is then trimmed, surface treated, stamped, and clear coated.

If the polymeric mantle layer is formed by a dry technique, the epoxy resin, such as in the dipping bath if the previously described wet method is used, can be impregnated into the fibers and molded as described above.

If the fiber is discontinuous, it can be applied to the core by simultaneously spraying a chopped fiber and a liquid resin to a revolving core or spherical substrate. The wet, wound center is then cured by molding as previously described.

With regard to the use of discontinuous fibers, the critical factors are the length to diameter ratio of the fiber, the shear strength of the bond between the fiber and the matrix, and the amount of fiber. All of these variables effect the overall strength of the composite mantle.

In preparing the preferred embodiment golf balls, the polymeric outer cover layer, if utilized, is molded (for instance, by injection molding or by compression molding) about the mantle.

Polymeric Hollow Sphere

As shown in the accompanying Figures, namely FIGS. 1 and 4, the first preferred embodiment golf ball 100 and the fourth preferred embodiment golf ball 400 comprise a polymeric hollow sphere 30 immediately adjacent and inwardly disposed relative to the mantle 20. The polymeric hollow sphere can be formed from nearly any relatively strong plastic material. The thickness of the hollow sphere ranges from about 0.005 inches to about 0.010 inches. The hollow inner sphere can be formed using two half shells joined together via spin bonding, solvent welding, or other techniques known to those in the plastics processing arts. Alternatively, the hollow polymeric sphere may be formed via blow molding.

A wide array of polymeric materials can be utilized to form the polymeric hollow sphere. Thermoplastic materials are generally preferred for use as materials for the shell. Typically, such materials should exhibit good flowability, moderate stiffness, high abrasion resistance, high tear strength, high resilience, and good mold release, among others.

Synthetic polymeric materials which may be used in accordance with the present invention include homopolymeric and copolymer materials which may include: (1) Vinyl resins formed by the polymerization of vinyl chloride, or by the copolymerization of vinyl chloride with vinyl acetate, acrylic esters or vinylidene chloride; (2) Polyolefins such as polyethylene, polypropylene, polybutylene, and copolymers such as polyethylene methylacrylate, polyethylene ethylacrylate, polyethylene vinyl acetate, polyethylene methacrylic or polyethylene acrylic acid or polypropylene acrylic acid or terpolymers made from these and acrylate esters and their metal ionomers, polypropylene/EPDM grafted with acrylic acid or anhydride modified polyolefins; (3) Polyurethanes, such as are prepared from polyols and diisocyanates or polyisocyanates; (4) Polyamides such as poly(hexamethylene adipamide) and others prepared from diamines and dibasic acids, as well as those from amino acid such as poly(caprolactam), and blends of polyamides with SURLYN, polyethylene, ethylene copolymers, EDPA, etc; (5) Acrylic resins and blends of these resins with polyvinyl chloride, elastomers, etc.; (6) Thermoplastic rubbers such as the urethanes, olefinic thermoplastic rubbers such as blends of polyolefins with EPDM, block copolymers of styrene and butadiene, or isoprene or ethylene-butylene rubber, polyether block amides; (7) Polyphenylene oxide resins, or blends of polyphenylene oxide with high impact polystyrene; (8) Thermoplastic polyesters, such as PET, PBT, PETG, and elastomers sold under the trademark HYTREL by E. I. DuPont De Nemours & Company of Wilmington, Del.; (9) Blends and alloys including polycarbonate with ABS, PBT, PET, SMA, PE elastomers, etc. and PVC with ABS or EVA or other elastomers; and (10) Blends of thermoplastic rubbers with polyethylene, polypropylene, polyacetal, nylon, polyesters, cellulose esters, etc.

It is also within the purview of this invention to add to the polymeric spherical substrate compositions of this invention materials which do not affect the basic characteristics of the composition. Among such materials are antioxidants, antistatic agents, and stabilizers.

Core

It should be appreciated that a wide variety of materials could be utilized for a core including solid materials, gels, hot-melts, liquids, and other materials which at the time of their introduction into a shell, can be handled as a liquid. Examples of suitable gels include water gelatin gels, hydrogels, and water/methyl cellulose gels. Hot-melts are materials that are heated to become liquid and at or about normal room temperatures become solid. This property allows their easy injection into the interior of the ball to form the core. Examples of suitable liquids include either solutions such as glycol/water, salt in water or oils or colloidal suspensions, such as clay, barytes, carbon black in water or other liquid, or salt in water/glycol mixtures.

A preferred example of a suitable liquid core material is solution of inorganic salt in water. The inorganic salt is preferably calcium chloride. Other liquids that have been successfully used are conventional hydraulic oils of the type sold at, for example, gasoline stations and that are normally used in motor vehicles.

The liquid material, which is inserted in the interior of the golf ball may also be reactive liquid systems that combine to form a solid. Examples of suitable reactive liquids are silicate gels, agar gels, peroxide cured polyester resins, two-part epoxy resin systems and peroxide cured liquid polybutadiene rubber compositions. It will be understood by those skilled in the art that other reactive liquid systems can likewise be utilized depending on the physical properties of the adjacent mantle and the physical properties desired in the resulting finished golf balls.

The core of all embodiments, whether remaining a solid, a liquid or ultimately becoming a solid, should be unitary, that is, of a substantially common material throughout its entire extent or cross-section, with its exterior surface in contact with substantially the entire interior surface of its shell or inner mantle. All cores are also essentially substantially homogenous throughout, except for a cellular or foamed embodiment described herein.

In the preferred embodiments, in order to provide a golf ball which has similar physical properties and functional characteristics to conventional golf balls, preferably the core material will have a specific gravity greater than that of the shell or mantle (and the outer cover when such a cover is molded over the shell). Specifically, the core material may have a specific gravity of between about 0.10 and about 3.9, preferably at about 1.05. Thus, it will be understood by those skilled in the art that the specific gravity of the core may be varied depending on the physical dimensions and density of the outer shell and the diameter of the finished golf ball. The core (that is, the inner diameter of the shell or mantle) may have a diameter of between about 0.860 inches and about 1.43 inches, preferably 1.30 inches.

Solid cores are typically compression molded from a slug of uncured or lightly cured elastomer composition comprising a high cis content polybutadiene and a metal salt of an $\alpha$, $\beta$, ethylenically unsaturated carboxylic acid such as zinc mono or diacrylate or methacrylate. To achieve higher coefficients of restitution in the core, the formulator may include a small amount of a metal oxide such as zinc oxide. In addition, larger amounts of metal oxide than are needed to achieve the desired coefficient may be included in order to increase the core weight so that the finished ball more closely approaches the U.S.G.A. upper weight limit of 1.620 ounces. Other materials may be used in the core composition including compatible rubbers or ionomers, and low molecular weight fatty acids such as stearic acid. Free radical initiator catalysts such as peroxides are admixed with the core composition so that on the application of heat and pressure, a complex curing or cross-linking reaction takes place.

The term "solid cores" as used herein refers not only to one piece cores but also to those cores having a separate solids layer beneath the cover and above the core as in U.S. Pat. No. 4,431,193, and other multi layer and/or non-wound cores.

Wound cores are generally produced by winding a very long elastic thread around a solid or liquid filled balloon center. The elastic thread is wound around a frozen center to produce a finished core of about 1.4 to 1.7 inches in diameter, generally. Since the core material is not an integral part of the present invention, a detailed discussion concerning the specific types of core materials which may be utilized with the cover compositions of the invention are not specifically set forth herein.

The preferred embodiment golf ball may also comprise a cellular core comprising a material having a porous or cellular configuration. Suitable materials for a cellular core include, but are not limited to, foamed elastomeric materials such as, for example, crosslinked polybutadiene/ZDA mixtures, polyurethanes, polyolefins, ionomers, metallocenes, polycarbonates, nylons, polyesters, and polystyrenes. Preferred materials include polybutadiene/ZDA mixtures, ionomers, and metallocenes. The most preferred materials are foamed crosslinked polybutadiene/ZDA mixtures.

If the cellular core is used in conjunction with a relatively dense mantle, the selection of the type of material for the mantle will determine the size and density for the cellular core. A hard, high modulus metal will require a relatively thin mantle so that ball compression is not too hard. If the mantle is relatively thin, the ball may be too light in weight so a cellular core will be required to add weight and, further, to add resistance to oil canning or deformation of the mantle.

The weight of the cellular core can be controlled by the cellular density. The cellular core typically has a specific gravity of from about 0.10 to about 1.0. The coefficient of restitution of the cellular core should be at least 0.500.

The structure of the cellular core may be either open or closed cell. It is preferable to utilize a closed cell configuration with a solid surface skin that can be metallized or receive a conductive coating. The preferred cell size is that required to obtain an apparent specific gravity of from about 0.10 to about 1.0.

In a preferred method, a cellular core is fabricated and a metallic cover applied over the core. The metallic cover may be deposited by providing a conductive coating or layer about the core and electroplating one or more metals on that coating to the required thickness. Alternatively, two metallic half shells can be welded together and a flowable cellular material, for example a foam, or a cellular core material precursor, injected through an aperture in the metallic sphere using a two component liquid system that forms a semi-rigid or rigid material or foam. The fill hole in the mantle may be sealed to prevent the outer cover stock from entering into the cellular core during cover molding. Application of these techniques will be appreciated and may be similarly used if the mantle is ceramic or polymeric.

If the cellular core is prefoamed or otherwise foamed prior to applying the metallic layer, the blowing agent may be one or more conventional agents that release a gas, such as nitrogen or carbon dioxide. Suitable blowing agents include, but are not limited to, azodicarbonamide, N,N-dinitros-opentamethylene-tetramine, 4-4 oxybis (benzenesulfonyl-hydrazide), and sodium bicarbonate. The preferred blowing agents are those that produce a fine closed cell structure forming a skin on the outer surface of the core.

A cellular core may be encapsulated or otherwise enclosed by the mantle, for instance by affixing two hemispherical halves of a shell together about a cellular core. It is also contemplated to introduce a foamable cellular core material precursor within a hollow spherical mantle and subsequently foaming that material in situ.

In yet another variant embodiment, an optional polymeric hollow sphere, such as for example, the hollow sphere substrate 30, may be utilized to receive a cellular material. One or more mantle layers, such as metal, ceramic, or polymeric mantle layers, can then be deposited or otherwise disposed about the polymeric sphere. If such a polymeric sphere is utilized in conjunction with a cellular core, it is preferred that the core material be introduced into the hollow sphere as a flowable material. Once disposed within the hollow sphere, the material may foam and expand in volume to the shape and configuration of the interior of the hollow sphere.

Other Aspects of Preferred Embodiment Ball Construction

Additional materials may be added to the outer cover 10 including dyes (for example, Ultramarine Blue sold by Whitaker, Clark and Daniels of South Plainsfield, N.J.) (see U.S. Pat. No. 4,679,795 herein incorporated by reference); optical brighteners; pigments such as titanium dioxide, zinc oxide, barium sulfate and zinc sulfate; UV absorbers; antioxidants; antistatic agents; and stabilizers. Further, the cover compositions may also contain softening agents, such as plasticizers, processing aids, etc. and reinforcing material such as glass fibers and inorganic fillers, as long as the desired properties produced by the golf ball covers are not impaired.

The outer cover layer may be produced according to conventional melt blending procedures. In the case of the outer cover layer, when a blend of hard and soft, low acid ionomer resins are utilized, the hard ionomer resins are blended with the soft ionomeric resins and with a masterbatch containing the desired additives in a Banbury mixer, two-roll mill, or extruder prior to molding. The blended composition is then formed into slabs and maintained in such a state until molding is desired. Alternatively, a simple dry blend of the pelletized or granulated resins and color masterbatch may be prepared and fed directly into an injection molding machine where homogenization occurs in the mixing section of the barrel prior to injection into the mold. If necessary, further additives such as an inorganic filler, etc., may be added and uniformly mixed before initiation of the molding process. A similar process is utilized to formulate the high acid ionomer resin compositions.

In place of utilizing a single outer cover, a plurality of cover layers may be employed. For example, an inner cover can be formed about the metal mantle, and an outer cover then formed about the inner cover. The thickness of the inner and outer cover layers are governed by the thickness parameters for the overall cover layer. The inner cover layer is preferably formed from a relatively hard material, such as, for example, the previously described high acid ionomer resin. The outer cover layer is preferably formed from a relatively soft material having a low flexural modulus.

In the event that an inner cover layer and an outer cover layer are utilized, these layers can be formed as follows. An inner cover layer may be formed by injection molding or compression molding an inner cover composition about a metal mantle to produce an intermediate golf ball having a diameter of about 1.50 to 1.67 inches, preferably about 1.620 inches. The outer layer is subsequently molded over the inner layer to produce a golf ball having a diameter of 1.680 inches or more.

In compression molding, the inner cover composition is formed via injection at about 380° F. to about 450° F. into smooth surfaced hemispherical shells which are then positioned around the mantle in a mold having the desired inner cover thickness and subjected to compression molding at 200° to 300° F. for about 2 to 10 minutes, followed by cooling at 50° to 70° F. for about 2 to 7 minutes to fuse the shells together to form a unitary intermediate ball. In addition, the intermediate balls may be produced by injection molding wherein the inner cover layer is injected directly around the mantle placed at the center of an intermediate ball mold for a period of time in a mold temperature of from 50° F. to about 100° F. Subsequently, the outer cover layer is molded about the core and the inner layer by similar compression or injection molding techniques to form a dimpled golf ball of a diameter of 1.680 inches or more.

After molding, the golf balls produced may undergo various further processing steps such as buffing, painting and marking as disclosed in U.S. Pat. No. 4,911,451 herein incorporated by reference.

The resulting golf ball produced from the high acid ionomer resin inner layer and the relatively softer, low flexural modulus outer layer exhibits a desirable coefficient of restitution and durability properties while at the same time offering the feel and spin characteristics associated with soft balata and balata-like covers of the prior art.

In yet another embodiment, a metal shell is disposed along the outermost periphery of the golf ball and hence, provides an outer metal surface. Similarly, a metal shell may be deposited on to a dimpled molded golf ball. The previously described mantle, which may comprise one or more metals, ceramic, or composite materials, may be used without a polymeric outer cover, and so, provide a golf ball with an outer surface of metal, ceramic, or composite material. Providing a metal outer surface produces a scuff resistant, cut resistant, and very hard surface ball. Furthermore, positioning a relatively dense and heavy metal shell about the outer periphery of a golf ball produces a relatively low spinning, long distance ball. Moreover, the high moment of inertia of such a ball will promote long rolling distances.

The invention has been described with reference to the preferred embodiments. Obviously, modifications and alterations will occur to others upon reading and understanding the proceeding detailed description. It is intended that the invention be construed as including all such modifications and alterations insofar as they come within the scope of the appended claims or the equivalents thereof.

We claim:

1. A golf ball comprising:

a core;

a thin spherical mantle encompassing said core, said mantle comprising (i) a polymeric material selected from the group consisting of epoxy-based materials, thermoset materials, nylon-based materials, styrene materials, thermoplastic materials, and combinations thereof, and (ii) a reinforcing material randomly dispersed throughout said polymeric material, said reinforcing material being selected from the group consisting of silicon carbide, glass, carbon, boron carbide, aramid materials, cotton, flax, jute, hemp, silk, and combinations thereof, wherein said mantle has a thickness in the range of from about 0.001 inch to about 0.100 inch, and a polymeric outer cover disposed about said mantle, said polymeric cover comprising a material selected from the group consisting of a high acid ionomer, a low acid ionomer, an ionomer blend, a non-ionomeric elastomer, a thermoset material, and combinations thereof.

2. The golf ball of claim 1 wherein said thermoset material of said mantle is selected from the group consisting of a polyimide thermoset, a silicone thermoset, a vinyl ester thermoset, a polyester thermoset, a melamine thermoset, and combinations thereof.

3. The golf ball of claim 1 wherein said nylon-based material is selected from the group consisting of nylon 6, nylon 6/10, nylon 6/6, nylon 11, and combinations thereof.

4. The golf ball of claim 1 wherein said styrene material is selected from the group consisting of acrylonitrile-butadiene styrene, polystyrene, styrene-acrylonitrile, styrene-maleic anhydride, and combinations thereof.

5. The golf ball of claim 1 wherein said thermoplastic material is selected from the group consisting of acetal copolymer, polycarbonate, liquid crystal polymer, polyethylene, polypropylene, polybutylene terephthalate, polyethylene terephthalate, polyphenylene, polyaryl, polyether, and combinations thereof.

6. The golf ball of claim 1 wherein said mantle has a thickness ranging from about 0.010 inch to about 0.030 inch.

7. The golf ball of claim 1 further comprising:

an innermost polymeric spherical substrate, said spherical substrate disposed adjacent to said inner surface of said mantle.

* * * * *